US008068032B2

(12) United States Patent
Fukui et al.

(10) Patent No.: US 8,068,032 B2
(45) Date of Patent: Nov. 29, 2011

(54) APPARATUS FOR COMMUNICATING WITH A RFID TAG

(75) Inventors: Tomoyasu Fukui, Inuyama (JP); Kunihiro Yasui, Nagoya (JP); Kazunari Taki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 506 days.

(21) Appl. No.: 12/242,890

(22) Filed: Sep. 30, 2008

(65) Prior Publication Data

US 2009/0045919 A1 Feb. 19, 2009

Related U.S. Application Data

(63) Continuation-in-part of application No. PCT/JP2007/053829, filed on Feb. 28, 2007.

(30) Foreign Application Priority Data

Mar. 30, 2006 (JP) ..... 2006-094823

(51) Int. Cl.
*G08B 21/00* (2006.01)

(52) U.S. Cl. ..... 340/572.7; 340/10.1; 340/10.51; 340/572.1; 340/572.8

(58) Field of Classification Search ..... None
See application file for complete search history.

(56) References Cited

U.S. PATENT DOCUMENTS

| | | | | |
|---|---|---|---|---|
| 2004/0032443 | A1* | 2/2004 | Moylan et al. | 347/19 |
| 2005/0162256 | A1* | 7/2005 | Kinoshita | 340/10.41 |
| 2006/0054681 | A1* | 3/2006 | Park et al. | 235/375 |
| 2006/0118229 | A1* | 6/2006 | Ohashi et al. | 156/60 |
| 2006/0244608 | A1* | 11/2006 | Cox | 340/572.7 |

FOREIGN PATENT DOCUMENTS

| | | | |
|---|---|---|---|
| JP | 2003-047781 | A | 2/2003 |
| JP | 2004-082432 | A | 3/2004 |
| JP | 2005-146543 | A | 6/2005 |
| JP | 2005-295188 | A | 10/2005 |
| JP | 2005-335129 | A | 12/2005 |
| JP | 2005-352768 | A | 12/2005 |
| JP | 2006-065731 | A | 3/2006 |

(Continued)

OTHER PUBLICATIONS

The International Bureau of WIPO, English Translation of the International Preliminary Report on Patentability for International Application No. PCT/JP2007/053829 (counterpart to above-captioned patent application), mailed Oct. 30, 2008.
Japanese Patent Office, International Search Report for International Application No. PCT/JP2007/053829, mailed May 29, 2007.
Japan Patent Office, Notice of Reasons for Rejection for Japanese Patent Application No. 2006-094823 (counterpart to above-captioned patent application), mailed Oct. 28, 2010.

* cited by examiner

*Primary Examiner* — Jennifer Mehmood
*Assistant Examiner* — Mark Rushing
(74) *Attorney, Agent, or Firm* — Baker Botts, L.L.P.

(57) ABSTRACT

An apparatus for communicating with a RFID tag that can improve versatility of the apparatus for communicating with a RFID tag, and further simplify equipment configuration and reduce costs of users by enabling information transmission/reception with a RFID circuit element in and outside the apparatus is provided. The apparatus for communicating with a RFID tag is provided with a housing constituting an outer profile of an apparatus main body and communicable regions both inside and outside the housing and has a loop antenna LC that can transmit/receive information with a RFID circuit element for a label production and a RFID circuit element for an information reading provided with an IC circuit part storing information and a loop antenna that transmits/receives information and a driving roller provided in the housing and configured to feed a tag label tape with print.

18 Claims, 34 Drawing Sheets

FIG. 12

RFID LABEL TYPE 13.56MHz, 100mm × 36mmTAG

PRINT CHARACTERS

R F - I D

ACCESS ID 1 6 , 7 7 7 , 2 1 5

ARTICLE INFORMATION 1 3 1 , 0 7 1

SERVER INFORMATION

2 , 0 9 7 , 1 5 1

APPARATUS FOR COMMUNICATING WITH A RFID TAG

CROSS-REFERENCE TO RELATED APPLICATION

This is a CIP application PCT/JP2007/53829, filed Feb. 28, 2007, which was not published under PCT article 21(2) in English and claims the benefits of Japanese Patent application No. 2006-094823 filed Mar. 30, 2006.

BACKGROUND OF THE INVENTION

1. Field of the Invention

The present invention relates to an apparatus for communicating with a RFID tag configured to transmit/receive information via radio communication with a RFID circuit element provided with an IC circuit part storing information and a tag antenna.

2. Description of the Related Art

A RFID (Radio Frequency Identification) system configured to read/write information contactlessly between a small-sized RFID tag and a reader (reading apparatus)/writer (writing apparatus) is known. For example, a RFID circuit element provided at a label-like RFID tag includes an IC circuit part storing predetermined RFID tag information and an antenna connected to the IC circuit part for information transmission/reception, and even if the RFID tag is stained or arranged at a hidden position, an access (information reading/writing) to the RFID tag information of the IC circuit part is possible from the reader/writer side, and practical use in various fields including merchandize control, inspection process and the like is expected.

As an apparatus for communicating with a RFID tag (recording apparatus) configured to write information in such RFID circuit element, the one described in JP, A, 2004-82432 is known. In this prior art, when a band-like tag tape (mount) on which a rectangular label pieces (labels) are bonded with a predetermined interval is fed out of a roll of a tape with RFID tags (roll paper) and fed on a feeding path, predetermined RFID tag information generated on the side of the apparatus is transmitted to the antenna of the RFID circuit element built in each label piece and sequentially written in the IC circuit part (IC chip) connected to the antenna, and print information corresponding to the written RFID tag information is printed by a printing device (recording head) on the surface of a RFID label so as to complete a RFID label.

In general, a RFID label produced by performing writing of RFID tag information by an apparatus for communicating with a RFID tag (writing apparatus) of the prior art and related print is provided on a target to be managed (products and the like) by affixation and the like. Then, by reading the RFID tag information out of the RFID label provided at the product and the like by a reader (reading apparatus), information relating to the product is obtained and management and the like of the product is conducted. In order to actually conduct product management and the like by producing the RFID label and using the same as above, a system provided with both functions as reader and writer is needed. However, a writer of prior art does not have a function as reader or even if it has such function, the reader function is constituted only for communication with a tag for writing and the reader function can not be applied to management of the product and the like. Thus, a reader should be prepared separately.

On the other hand, in the apparatus for communicating with a RFID tag of the prior art, if a usual print label not provided with a RFID circuit element is to be produced, for example, an apparatus antenna configured to perform radio communication with a RFID circuit element and a command-information generating portion configured to generate command information are not required. In such a case, if the apparatus antenna and the command-information generating portion can be used for another purpose, convenience can be improved. There is also an advantage that even while the RFID label is not produced, the apparatus antenna and the command-information generating portion are not left idle but can be used effectively, for example.

SUMMARY OF THE INVENTION

The present invention has an object to provide an apparatus for communicating with a RFID tag that can improve convenience, and further simplify equipment configuration and reduce costs of users by enabling information transmission/reception with a RFID circuit element in and outside the apparatus.

BRIEF DESCRIPTION OF THE DRAWING

FIGS. 11A to 11C are a diagram obtained by rotating a cross sectional view by XIA-XIA' section in FIG. 10A counterclockwise by 90°, a diagram obtained by rotating a cross sectional view by XIB-XIB' section in FIG. 10A counterclockwise by 90°, and a bottom view of the RFID label when a hole substantially penetrating the base tape is drilled as an identification mark by laser machining and the like.

FIG. 12 is a view illustrating an example of a screen displayed on a PC (terminal or a general-purpose computer) at an access by the apparatus for producing RFID labels to RFID tag information of an IC circuit part of the RFID circuit element.

DETAILED DESCRIPTION OF THE PREFERRED EMBODIMENTS

An apparatus for producing RFID labels according to an embodiment of the present invention will be described below referring to the attached drawings. The present embodiment is an embodiment when the present invention is applied to a RFID tag manufacturing system.

Figure 1:
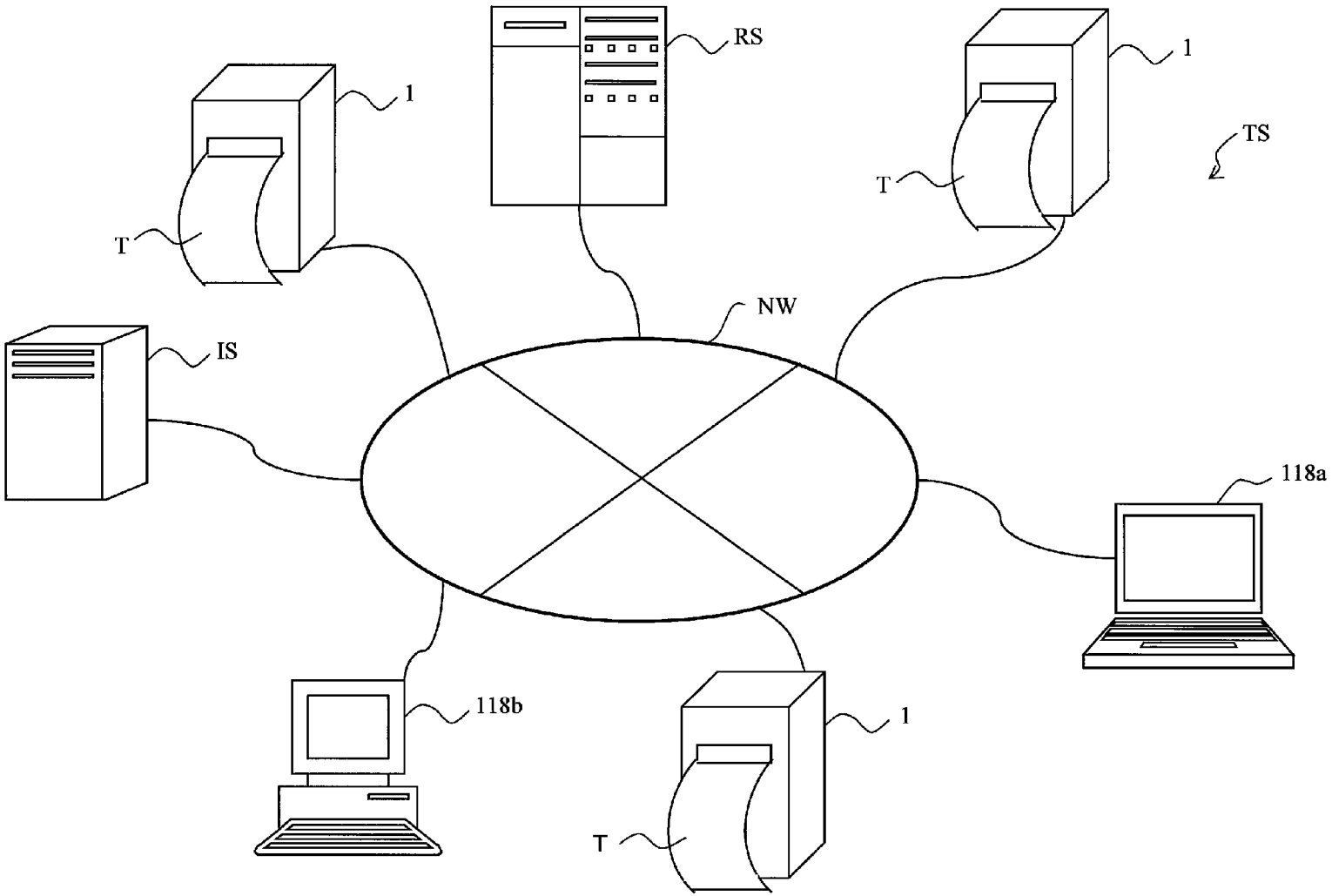
FIG. 1 is a system block diagram illustrating a RFID tag manufacturing system provided with an apparatus for producing RFID labels of an embodiment of the present invention.

FIG. 1 is a system block diagram illustrating a RFID tag manufacturing system provided with the apparatus for producing RFID labels of the present embodiment.

In the RFID tag manufacturing system TS shown in FIG. 1, an apparatus 1 for producing RFID labels (apparatus for communicating with a RFID tag) is connected to a terminal 118*a*, and a general-purpose computer 118*b* connected to a route server RS and a plurality of information servers IS through a wired or radio communication line NW. The terminal 118*a* and the general-purpose computer 118*b* are collectively referred to simply as "PC 118" below as appropriate.

Figure 2:
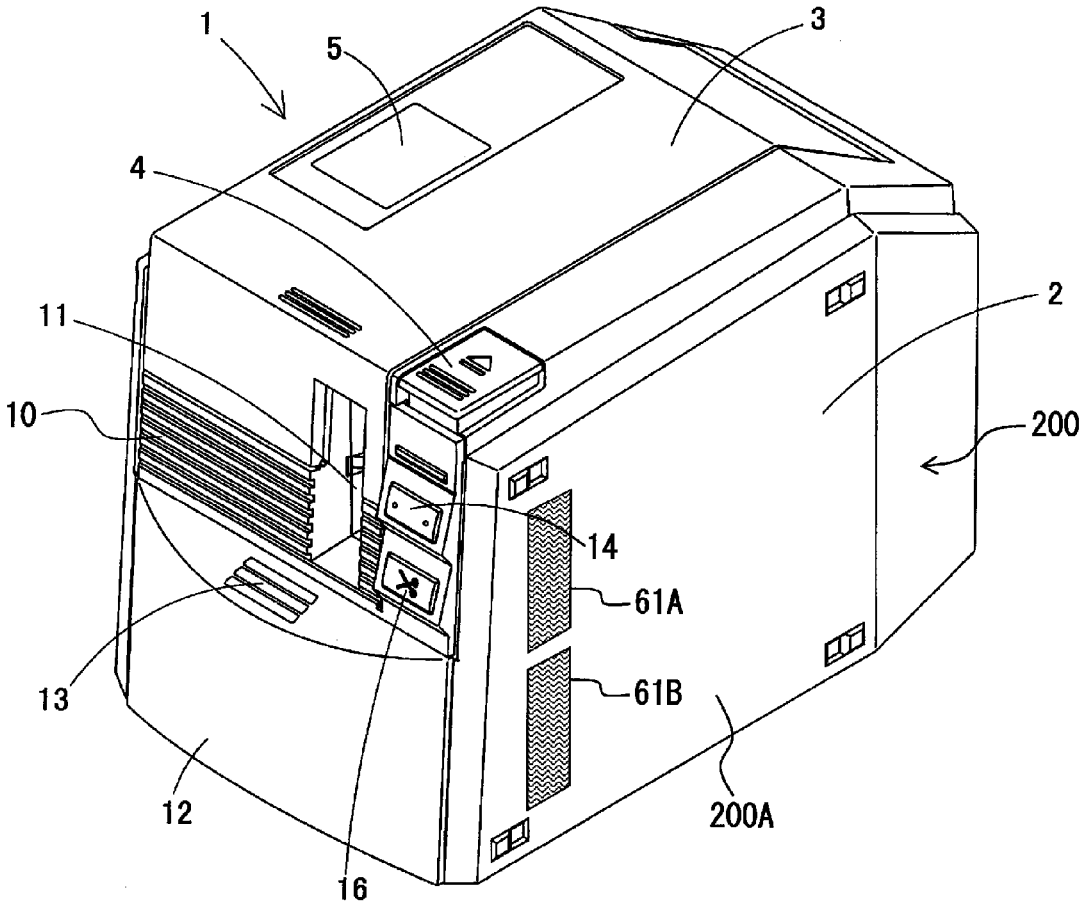
FIG. 2 is a perspective view illustrating the entire structure of the apparatus for producing RFID labels.

FIG. 2 is a perspective view illustrating the entire structure of the apparatus 1 for producing RFID labels.

In FIG. 2, the apparatus 1 for producing RFID labels is connected to the PC 118 and produces a RFID label with desired print based on an operation from the PC 118 and has an apparatus main body 2 having a substantially hexagonal (substantially cubic) housing 200 on the outline and an opening/closing lid 3 provided on an upper face of the apparatus main body 2, capable of being opened/closed.

The housing 200 of the apparatus main body 2 comprises a front wall 10 located at the device front side (left front side in FIG. 2) and provided with a label carry-out exit 11 (carry-out exit) configured to discharge a RFID label T (which will be described later) produced inside the apparatus main body 2 to the outside and a front lid 12 provided below the label carry-out exit 11 in the front wall 10 and having its lower end rotatably supported.

Below an opening/closing button 4 in the front wall 10, a power button 14 configured to power on/off the apparatus 1 for producing RFID labels is provided. Below the power button 14, a cutter driving button 16 configured to drive a cutting mechanism 15 (See FIG. 3, which will be described later) disposed in the apparatus main body 2 through manual operation by a user is provided, and by pushing this button 16, a tag label tape 109 with print (which will be described later) is cut to a desired length so as to produce the RFID label T.

The housing 200 is provided with a side wall 200A on the side face of the apparatus (front right side in FIG. 2), and at upper and lower parts on the front side of the side wall 200A, display portions 61A, 61B which display positions over which a RFID circuit element To-R (RFID label and the like) for an information reading is placed when the apparatus 1 for producing RFID labels is used in a scan mode (the detail will be described later) are provided (for details, see FIG. 4B, which will be described later).

Figure 3:
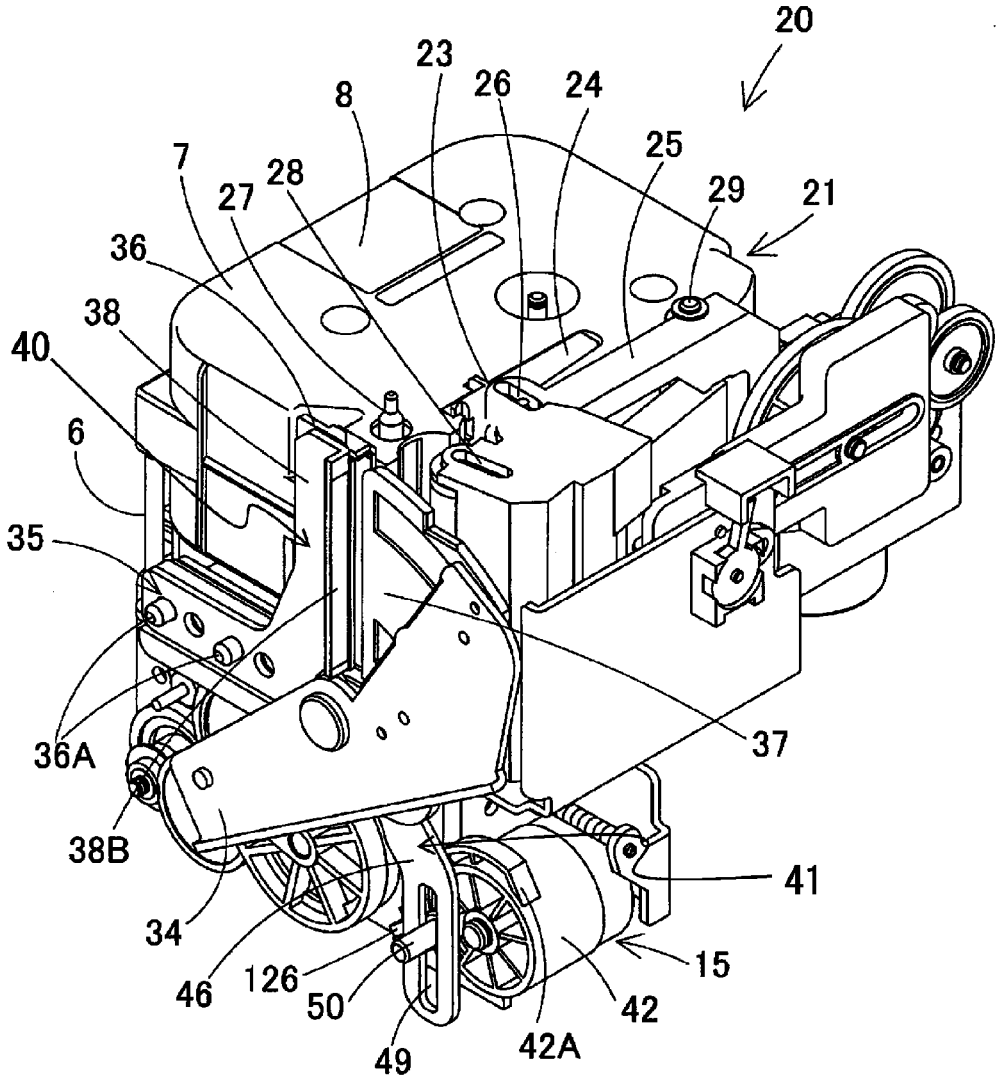
FIG. 3 is a perspective view illustrating an appearance and structure of an internal unit inside the apparatus for producing RFID labels.

FIG. 3 is a perspective view illustrating a structure of an internal unit 20 inside the apparatus 1 for producing RFID labels (however, a loop antenna LC, which will be described later, is omitted). In FIG. 3, the internal unit 20 comprises a cartridge holder 6 (container holder) configured to accommodate a cartridge 7 (container for including at least a RFID tag), a printing mechanism 21 provided with a print head (thermal head) 23, the cutting mechanism 15 (cutter), a half-cut unit 35, and a label discharging mechanism 22 (See FIG. 4, which will be described later) configured to discharge the produced RFID label T (See FIG. 10, which will be described later) from the label carry-out exit 11 (See FIG. 2).

Figure 4A:
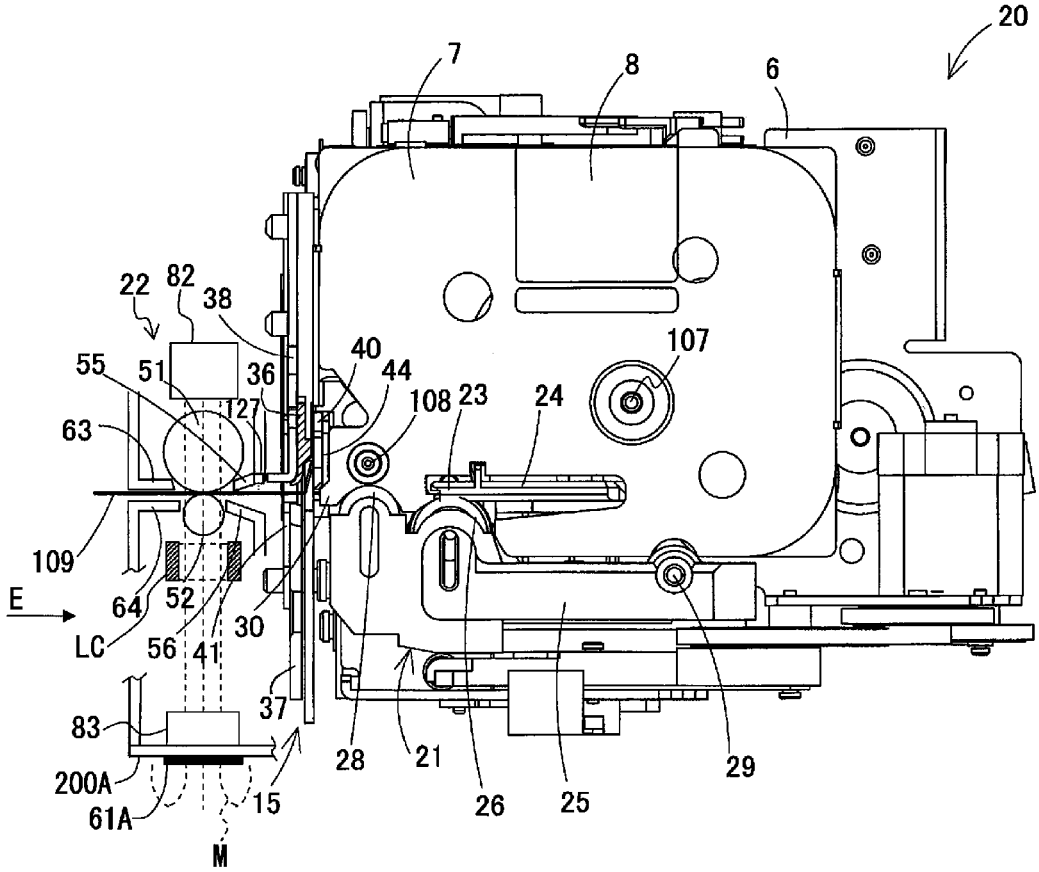
FIGS. 4A and 4B are a plan view illustrating a structure of the internal unit inside the apparatus for producing RFID labels and a conceptual diagram illustrating a route of a magnetic path generated by a loop antenna.
Figure 4B:
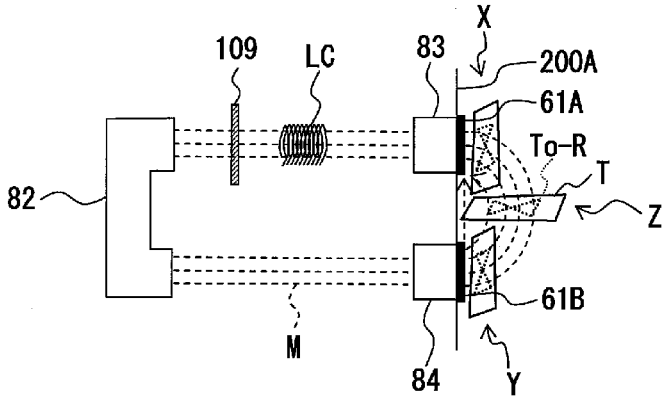
Figure 5:
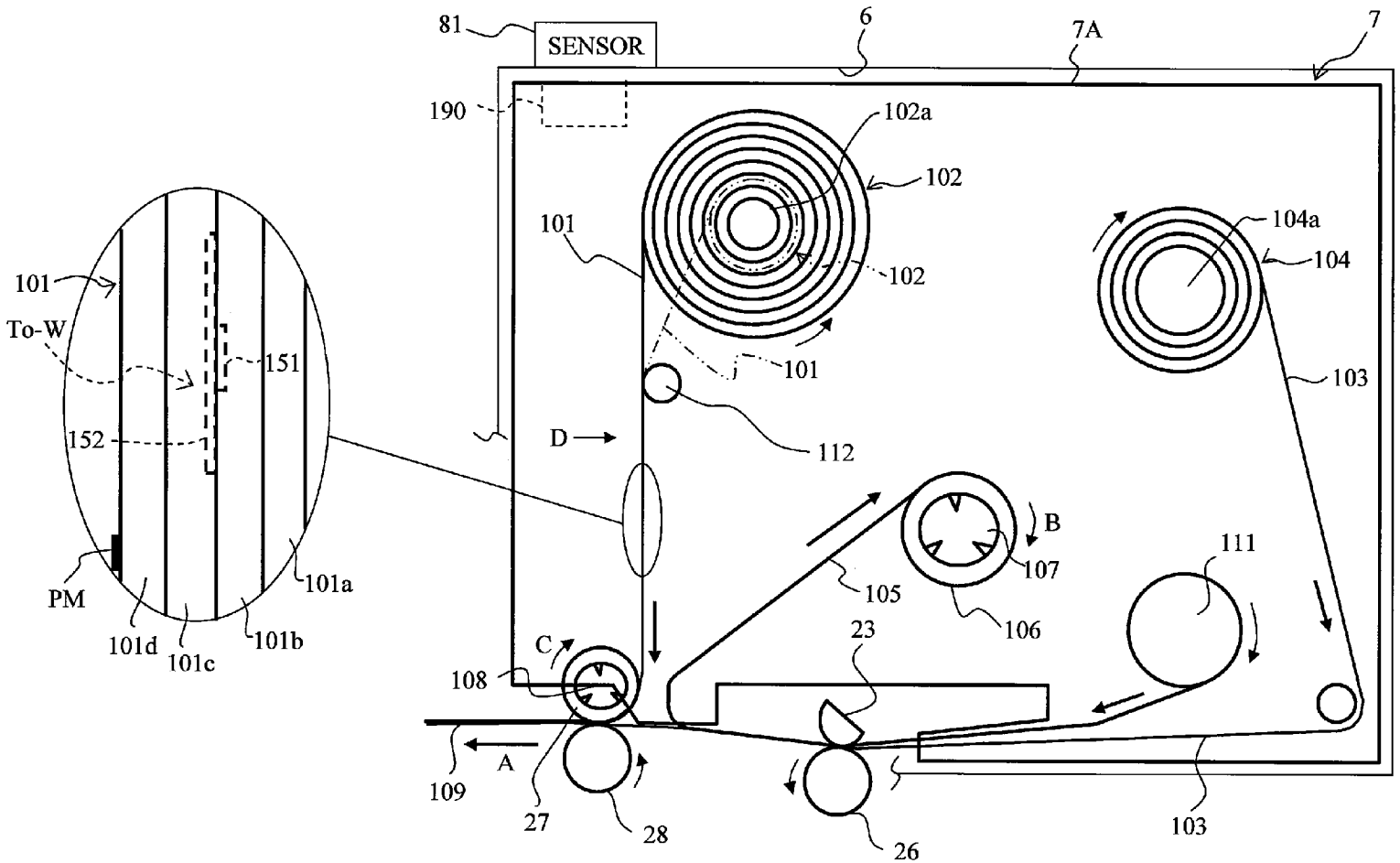
FIG. 5 is an enlarged plan view schematically illustrating a detailed structure of a cartridge.

FIG. 4A is a plan view illustrating a structure of the internal unit 20 shown in FIG. 3, and FIG. 4B is a conceptual diagram of route of a magnetic path M generated by the loop antenna LC viewed from an arrow E direction in FIG. 4A. FIG. 5 is an enlarged plan view schematically illustrating a detailed structure of the cartridge 7.

In FIGS. 4A, 4B, and 5, the cartridge 7 is accommodated in the cartridge holder 6 so that a widthwise direction of the tag label tape 109 with print (label medium) discharged from the label carry-out exit 11 is a vertical direction. The cartridge 7 has a housing 7A provided with a tape specific display portion 8, a first roll 102 which is arranged in the housing 7A and around which a band-like base tape 101 (feeding medium, tag medium) is wound (actually wound in the spiral state but simplified and shown with a concentric circle. The same applies to the following), a second roll 104 around which a transparent cover film 103 with the substantially same width as that of the base tape 101 is wound, a ribbon-supply-side roll 111 that feeds out an ink ribbon 105 (heat transfer ribbon, however, it is not needed if the print-receiving tape is a thermal tape), a ribbon take-up roller 106 that takes up the ribbon 105 after print, a feeding roller 27 rotatably supported in the vicinity of a tape discharge portion 30 of the cartridge 7, and a guide roller 112 that functions as feeding position regulating means.

The feeding roller 27 presses and bonds the base tape 101 and the cover film 103 so as to have the tag label tape 109 with print while feeding the tape in a direction shown by an arrow A (=also functioning as a pressure roller).

The first roll 102 has the base tape 101 on which a plurality of RFID circuit elements To-W for a label production is sequentially formed with a predetermined equal interval in the longitudinal direction wound around a reel member 102*a*. The base tape 101 has a four-layered structure (See the partially enlarged view in FIG. 5) in this example and is constructed in lamination in the order of an adhesive layer 101*a* made of an appropriate adhesive, a colored base film 101*b* made of polyethylene terephthalate (PET) and the like, an adhesive layer 101*c* made of an appropriate adhesive, and a separation sheet (separation material) 101*d* from the side wound inside (right side in FIG. 5) toward the opposite side (left side in FIG. 5).

On the back side of the base film 101*b* (left side in FIG. 5), a loop antenna 152 (tag antenna) constructed in the loop-coil shape for transmission/reception of information is provided integrally in this embodiment, an IC circuit part 151 storing information is formed so as to be connected thereto, and the RFID circuit element To-W for a label production is constituted by them.

On the front side of the base film 101*b* (right side in FIG. 5), the adhesive layer 101*a* for affixing the cover film 103 later is formed, while on the back side of the base film 101*b* (left side in FIG. 5), the separation sheet 101*d* is affixed to the base film 101*b* by the adhesive layer 101*c* provided so as to include the RFID circuit element To-W for a label production.

When the RFID label T finally completed in the label state is to be affixed to a predetermined article or the like, the separation sheet 101*d* enables adhesion to the article or the like by the adhesive layer 101*c* through separation of the separation sheet. Also, on the surface of the separation sheet 101*d*, at a predetermined position (in this example, a position on the further front from the tip end of the antenna 152 in the front in the feeding direction) corresponding to each RFID circuit element To-W for a label production, a predetermined identification mark for feeding control (an identification mark painted in black in this example. Alternatively, it may be a drilled hole penetrating the base tape 101 by laser machining or the like. Alternatively, it may be a Thomson type machined hole or the like.) PM is provided.

The second roll 104 has the cover film 103 wound around a reel member 104*a*. In the cover film 103 fed out of the second roll 104, the ribbon 105 driven by the ribbon-supply-side roll 111 and the ribbon take-up roller 106 arranged on its back face side (that is, the side to be affixed to the base tape 101) is brought into contact with the back face of the cover film 103 by being pressed by the print head 23.

When the cartridge 7 is attached to the cartridge holder 6 and a roll holder 25 is moved from a release position to a printing position, the cover film 103 and the ink ribbon 105 are held between the print head 23 and a platen roller 26, and the base tape 101 and the cover film 103 are held between the feeding roller 27 and a tape feeding roller 28. Then, the ribbon take-up roller 106 and the feeding roller 27 are rotated and driven by a driving force of a feeding motor 119 in a direction shown by an arrow B and an arrow C, respectively, in synchronization with each other. At this time, a feeding roller driving shaft 108, the tape feeding roller 28 and the platen roller 26 are connected through a gear mechanism (not shown), and with the driving of the feeding roller driving shaft 108, the feeding roller 27, the tape feeding roller 28, and the platen roller 26 are rotated, and the base tape 101 is fed out of the first roll 102 and supplied to the feeding roller 27 as mentioned above. On the other hand, the cover film 103 is fed out of the second roll 104, and the plurality of heater elements of the print head 23 is electrified by a print-head driving circuit 120 (See FIG. 8, which will be described later). As a result, print R (See FIG. 10, which will be described later) corresponding to the RFID circuit element To-W for a label production on the base tape 101 to be the bonding target is printed on the back face of the cover film 103. Then, the base tape 101 and the cover film 103 on which the printing has been finished are bonded together by the feeding roller 27 and the tape feeding roller 28 to be integrated and formed as the tag label tape 109 with print and fed out of the cartridge 7 through the tape discharge portion 30. The ink ribbon 105 finished with printing on the cover film 103 is taken up by the ribbon take-up roller 106 by driving of a ribbon take-up roller driving shaft 107.

Also, at an appropriate position of the housing 7A in the cartridge 7, a portion 190 to be detected (object to be detected) provided with a concavo-convex shape is provided. The concavo-convex shape of the portion 190 to be detected is detected by a cartridge sensor 81 (container-presence/absence detecting device, container-information detecting device) provided at a corresponding position of the cartridge holder 6, and its detection signal is input to a control circuit 110 (See FIG. 8, which will be described later). At this time, correlation information between the shape of the portion 190 to be detected and cartridge information of the cartridge 7 at which the portion 190 to be detected is provided (whether the cartridge 7 is for a tag label production or for a usual label production not having a tag, tag ID information of all the RFID circuit elements To-W for a label production present in the cartridge in the case for a tag label production, and the like) is stored in the information server IS, for example, so that the control circuit 110 accesses the information server IS via the communication line NW and obtains the cartridge information of the cartridge 7 based on the input detection signal. The cartridge sensor 81 also serves as an attachment detection sensor that detects an attached state of the cartridge 7 so that the control circuit 110 detects that the cartridge 7 has been attached to the cartridge holder 6 upon input of the detection signal from the cartridge sensor 81.

On the other hand, as mentioned above, the internal unit 20 is provided with the cutting mechanism 15 and the label discharge mechanism 22 and further provided with a single loop antenna LC (apparatus antenna device) having communicable regions both inside and outside of the housing 200. The loop antenna LC is capable of writing or reading of information via radio communication both to the RFID circuit element To-W for a label production provided at the base tape 101 (tag label tape with print after bonding, the same applies to the following) and to the RFID circuit element To-R for an information reading located outside the apparatus main body 2 (housing 200). Moreover, the internal unit 20 is provided with a plurality of magnetic members 82, 83, 84 that guide a magnetic path M generated by the loop antenna LC to a predetermined route.

As shown in FIG. 4B, the magnetic member 82 is the one substantially in the U-shape constituted by ferrite and the like, for example, and is provided on the side opposite to the loop antenna LC with a feeding path of the tag label tape 109 with print between them. Also, the magnetic members 83, 84 are similarly magnetic members constituted by ferrite and the like and are provided at positions corresponding to the display portions 61A, 61B inside the housing side wall 200A, respectively. By these magnetic members 82, 83, 84, the magnetic path M generated by the loop antenna LC is formed, as shown in FIG. 4B, so as to reach the magnetic member 82 from the loop antenna LC through the feeding path of the tag label tape 109 with print, to reach the magnetic member 84 from this magnetic member 82 through the lower side of the tape feeding path, to reach the magnetic member 83 from this magnetic member 84 through outside the apparatus housing 200 and to return to the loop antenna LC after that. As a result, information can be transmitted/received with respect to the RFID circuit element TO-W for a label production provided at the tag label tape 109 with print and the RFID circuit element To-R for an information reading located outside the apparatus main body 2 (housing 200) through the loop antenna LC.

In the case of communication with the RFID circuit element To-R for an information reading located outside the apparatus main body 2 (housing 200), an operator places, as shown in FIG. 4B, the RFID circuit element To-R (RFID label T and the like) to be read out so that the RFID circuit element To-R becomes substantially in parallel with the display portion 61A (X state in the figure), the RFID circuit element To-R becomes substantially in parallel with the display portion 61B (Y state in the figure), or the RFID circuit element To-R is substantially at a right angle with the magnetic path M in the magnetic path M passing through outside of the apparatus housing 200 in the middle, for example, so that information can be transmitted/received between the loop antenna LC and the RFID circuit element To-R, and the RFID tag information of the placed RFID circuit element To-R can be read out.

The magnetic member is provided so as to guide the magnetic path M of the loop antenna LC in the above configuration, but not limited to that, configuration without providing a magnetic member is possible. Also, instead of the loop antenna, a dipole antenna may be used. Though not particularly provided here, a shield member that shields an electromagnetic wave may be provided between a region for radio communication between the loop antenna LC and the RFID circuit element To-W for a label production provided at the tag label tape 109 with print (that is, the vicinity to a contact position between the pressure roller 52 and the tag label tape 109 with print) and the cartridge holder 6 so that the magnetic path M generated by the loop antenna LC does not affect the RFID circuit element To-W for a label production in the cartridge 7. Moreover, a shield member may be also provided on the front side in a region for radio communication between the loop antenna LC and the RFID circuit element To-W for a label production so that the magnetic path M generated by the loop antenna LC does not leak to the front side of the apparatus main body 2 (left side in FIG. 4).

After information reading or writing has been performed in the RFID circuit element To-W for a label production by the loop antenna LC with respect to the tag label tape 109 with print generated by bonding as above, the tag label tape 109 with print is cut by the cutting mechanism 15 automatically or by operating the cutter driving button 16 (See FIG. 2) so as to produce the RFID label T. The RFID label T is further discharged from the label carry-out exit 11 formed at the side wall 10 (See FIG. 2) by the label discharge mechanism 22 after that.

Also, the label discharge mechanism 22 has a mark sensor 127 (See FIG. 4A) that detects an identification mark PM provided at the separation sheet 101*d* of the tag label tape 109 with print.

Figure 6:
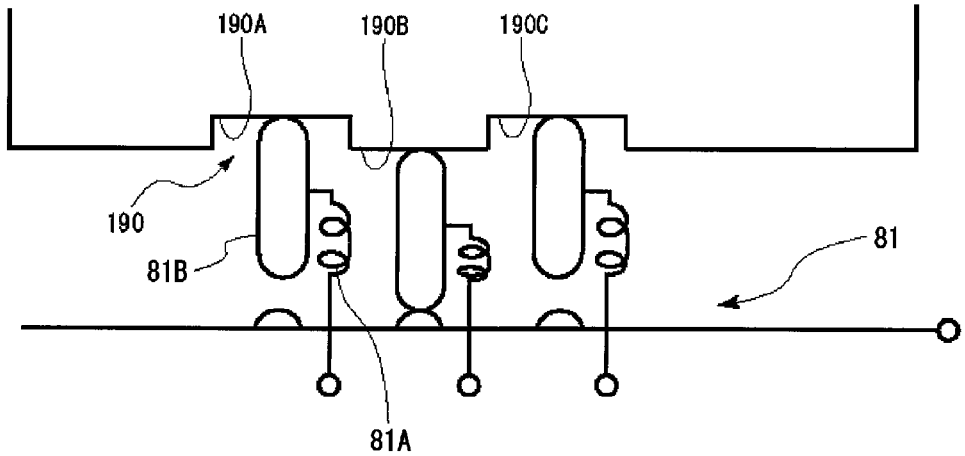
FIG. 6 is an explanatory diagram illustrating an example of configuration of a cartridge sensor.

FIG. 6 is an explanatory diagram illustrating an example of configuration of the cartridge sensor 81.

In FIG. 6, the cartridge sensor 81 is, in this example, a mechanical switch that detects the concave-convex shape by urging and bringing a contact 81B in contact by a spring member 81A with identifiers 190A to C of the portion 190 to be detected provided with the concave-convex shape and is configured so that a detection signal is output from the contact 81B arranged in correspondence with each of projecting and recess portions to the control circuit 110.

As mentioned above, the identifiers 190A to C represent the cartridge information of the cartridge 7 (information whether the cartridge 7 is for a tag label production or for an usual label production not having a tag, tag ID information of all the RFID circuit elements To-W for a label production present in the cartridge in the case for a tag label production, and the like) by presence or absence of the projections and recesses, and the cartridge sensor 81 detects the concave-convex shape of the identifiers 190A to C and outputs it to the control circuit 110. As a result, the control circuit 110 accesses the information server IS through the communication line NW so that the cartridge information associated with the input detection signal can be obtained.

The cartridge sensor 81 as the above detecting device is not limited to the mechanical switch but may be a sensor of another method such as a sensor using reflection of light, for example. In this case, the sensor is provided with a light emitting diode that emits light by a signal from the control circuit 110 and a photo transistor that receives reflected light of the emitted light at each of the identifiers 190A to C and outputs a corresponding detection signal to the control circuit 110, for example. Alternatively, for example, a RFID circuit element To in which RFID circuit element information is written (so-called cartridge tag) is provided at the housing 7A of the cartridge 7, and it may be so configured that the RFID tag circuit element information relating to the cartridge 7 is obtained by reading the information of the cartridge tag by an antenna for cartridge tag reading provided at a corresponding position of the cartridge holder 6.

Figure 7:
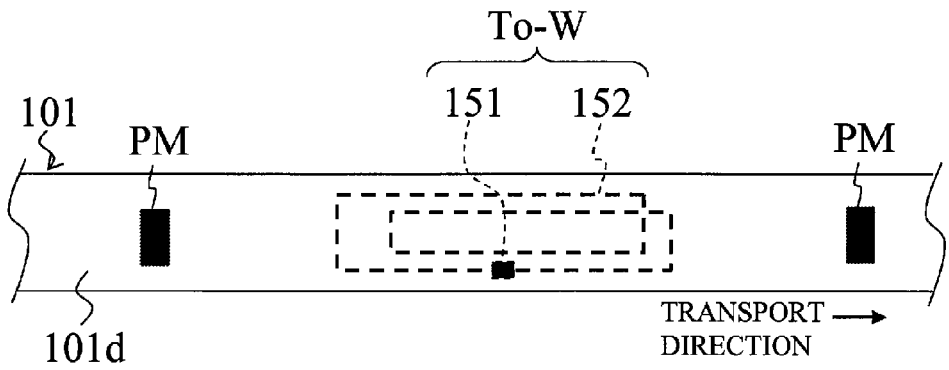
FIG. 7 is a conceptual diagram illustrating conceptual configuration of a RFID circuit element provided at a base tape fed out of a first roll viewed from an arrow D direction in FIG. 5.

FIG. 7 is a conceptual diagram viewed from an arrow D direction in FIG. 5, illustrating conceptual configuration of the RFID circuit element To-W for a label production provided at the base tape 101 fed out of the first roll 102. In FIG. 7, the RFID circuit element To-W for a label production comprises the loop antenna 152 configured in a loop coil shape for information transmission/reception and the IC circuit part 151 connected thereto and storing information. On the surface of the separation sheet 101*d*, at a predetermined position corresponding to each of the RFID circuit elements To-W, the above-mentioned identification mark PM is provided, respectively.

Returning to FIGS. 3 and 4, the loop antenna LC is arranged close to the pressure roller 52 so that the pressure roller 52 is located at the center in its radial direction (inside in the radial direction. In more detail, on the coil center axis) for making an access to the RFID circuit element To-W for a label production (information reading or information writing) provided at the tag label tape 109 with print and to the RFID circuit element To-R for an information reading located outside the apparatus main body 2 (housing 200) (information reading, here) by magnetic induction (including electromagnetic induction, magnetic coupling, and other non-contact methods performed through an electromagnetic field). Here, the loop antenna LC is arranged so that the pressure roller 52 is located at the center in its radial direction, but not limited to that, the antenna may be arranged so that the pressure roller 52 is located outside in the radial direction.

On the upstream side in the feeding direction than the driving roller 51, the mark sensor 127 that can detect an appropriate identification mark PM (See FIG. 5 and the like) provided in correspondence with a position of each of the RFID circuit elements To-W is provided at the separation sheet 101*d* of the base tape 101. This mark sensor 127 is a known reflection type photoelectric sensor, for example. As the mark sensor 127, a transmission type photoelectric sensor may be used, not limited to the reflection type.

The half-cut unit 35 comprises a receiver 38 arranged in accordance with a fixed blade 40, a half-cutter 34 arranged on the side of a movable blade 41 opposite the receiver 38, a first guide portion 36 arranged in accordance with the fixed blade 40 between the fixed blade 40 and the receiver 38, and a second guide portion 37 arranged in accordance with the movable blade 41 opposite the first guide portion 36.

Figure 8:
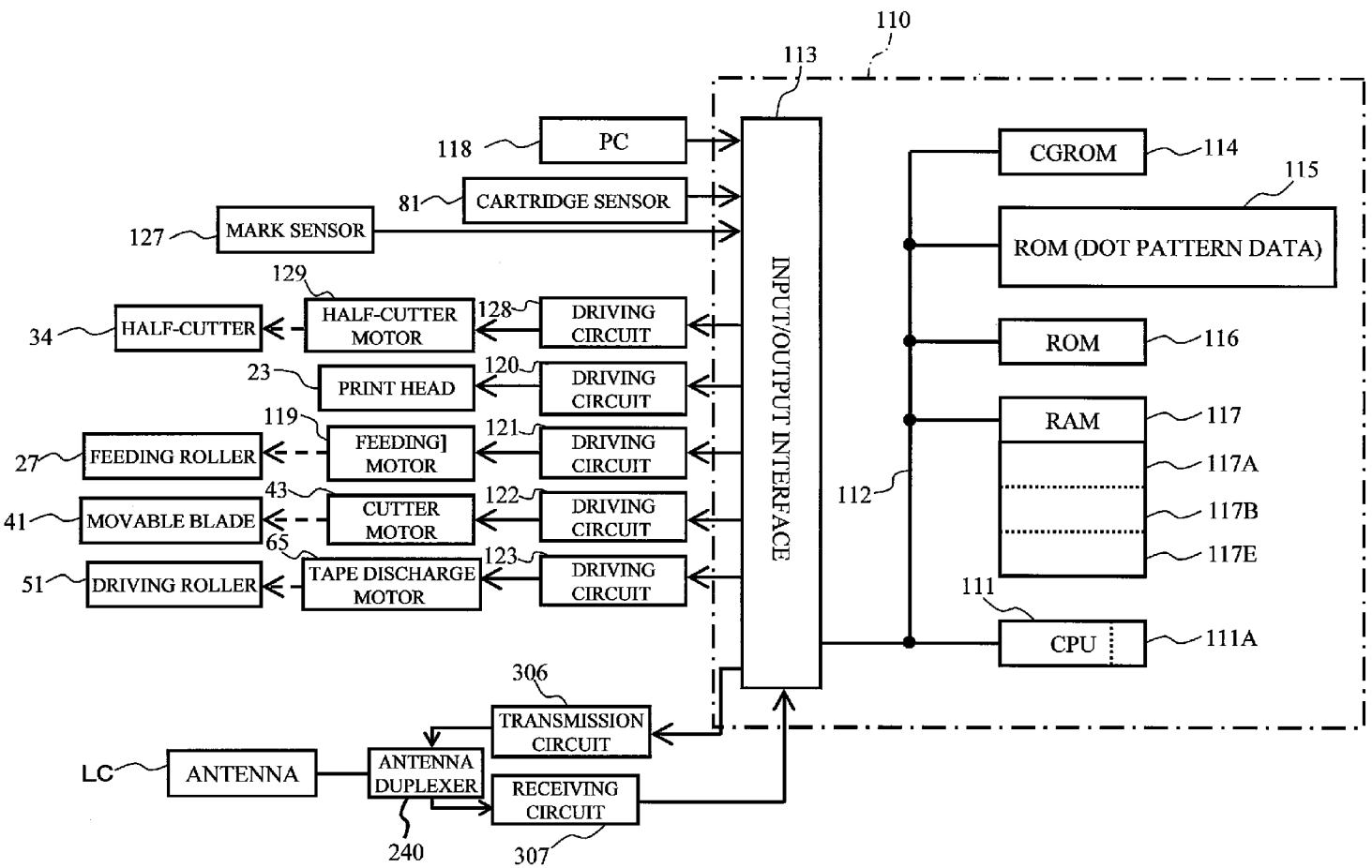
FIG. 8 is a functional block diagram illustrating a control system of the apparatus for producing RFID labels, which is an embodiment of the present invention.

FIG. 8 is a functional block diagram illustrating a control system of an apparatus 1 for producing RFID labels of this embodiment. In FIG. 8, the control circuit 110 is arranged on a control board (not shown) of the apparatus 1 for producing RFID labels.

In the control circuit 110, a CPU 111 provided with a timer 111A inside for controlling each device, an input/output interface 113 connected to the CPU 111 through a data bus 112, a CGROM 114, a ROM 115, 116, and a RAM 117.

In the ROM 116, a print driving control program that reads out data of print buffer in correspondence with character code data of characters, numerals and the like input from the PC 118 so as to drive the print head 23, the feeding motor 119, and a tape discharge motor 65, a pulse number determining program that determines the pulse number corresponding to a formation energy amount of each print dot, a cutting driving control program that feeds the tag label tape 109 with print to a cutting position by driving the feeding motor 119 when print has been finished so as to cut the tag label tape 109 with print by driving a cutter motor 43, a tape discharge program that forcedly discharges the tag label tape 109 with print having been cut (=RFID label T) from the label carry-out exit 11 by driving the tape discharge motor 65, and other various programs required for control of the apparatus 1 for producing RFID labels are stored. The CPU 111 carries out various calculations based on such various programs stored in the ROM 116.

To the input/output interface 113, the PC 118, the print-head driving circuit 120 for driving the print head 23, a feeding motor driving circuit 121 for driving the feeding motor 119, a cutter motor driving circuit 122 for driving the cutter motor 43, a half-cutter motor driving circuit 128 for driving a half-cutter motor 129, a tape discharge motor driving circuit 123 for driving the tape discharge motor 65, the transmission circuit 306 that generates a carrier wave for making an access to (performing reading/writing) the RFID circuit elements To-W, To-R through the loop antenna LC and modulates the carrier wave based on a control signal input from the control circuit 110, the receiving circuit 307 that demodulates a response signal received from the RFID circuit elements To-W, To-R through the loop antenna LC and outputs it to the control circuit 110, the mark sensor 127 that detects the identification mark PM, and the cartridge sensor 81 that detects the concave-convex shape of the portion 190 to be detected provided at the cartridge housing 7A are connected, respectively.

Also, the transmission circuit 306 and the receiving circuit 307 are connected to the loop antenna LC through an antenna duplexer 240. With this configuration, transmission and reception of a signal with the RFID circuit elements To-W, To-R using the single loop antenna LC is possible.

In the control system with such control circuit 110 as its core, when character data and the like is input through the PC 118, its text (document data) is sequentially stored in a text memory 117A, the print head 23 is driven through the driving circuit 120, each of heater elements is selectively heated and driven in correspondence with print dots for one line so as to print dot pattern data stored in a print buffer 117B, and the feeding motor 119 performs feeding control of a tape through the driving circuit 121 in synchronization therewith. Also, the transmission circuit 306 performs modulation control of the carrier wave based on the control signal from the control circuit 110, while the receiving circuit 307 executes processing of a signal demodulated based on the control signal from the control circuit 110.

Figure 9:
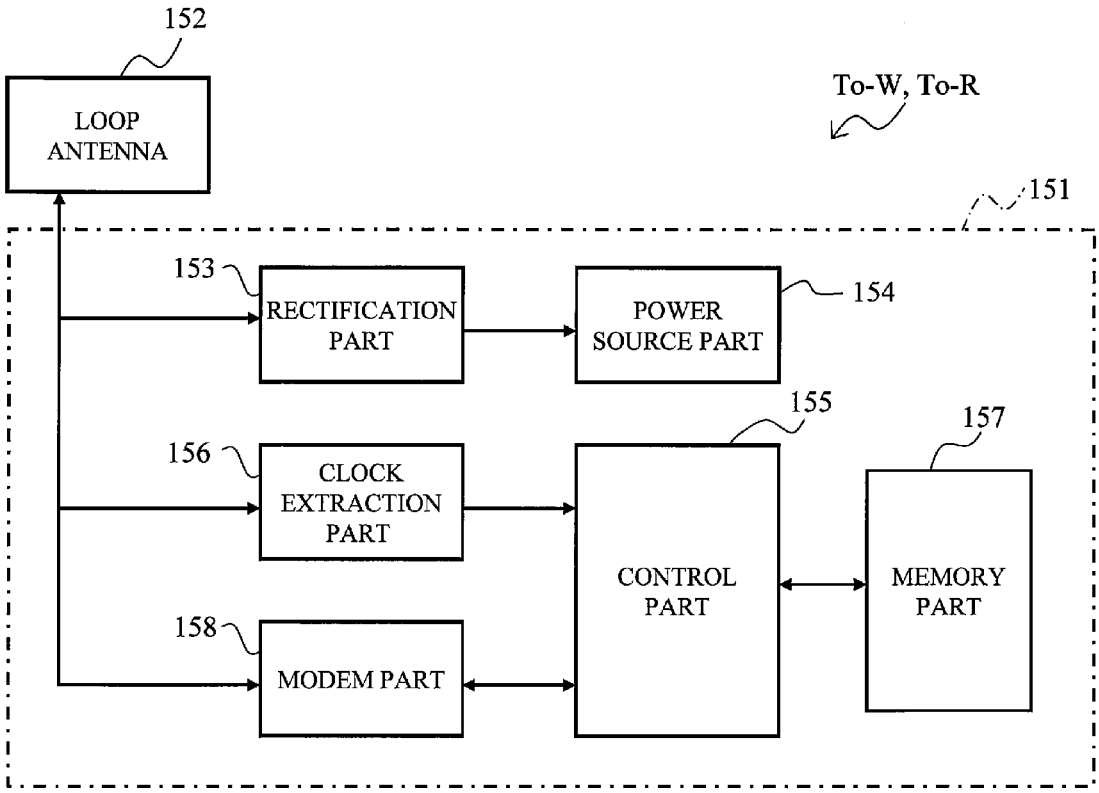
FIG. 9 is a functional block diagram illustrating functional configuration of the RFID circuit element.

FIG. 9 is a functional block diagram illustrating functional configuration of the RFID circuit element To-W for a label production and the RFID circuit element To-R for an information reading. Since the RFID circuit element To-W for a label production and the RFID circuit element To-R for an information reading have the equivalent configuration, they are described together. In FIG. 9, the RFID circuit elements To-W, To-R have the loop antenna 152 for signal transmission/reception contactlessly by the loop antenna LC on the side of the apparatus 1 for producing RFID labels and magnetic induction and the IC circuit part 151 connected to the loop antenna 152.

The IC circuit part 151 has a rectification part 153 configured to rectify a carrier wave received by the loop antenna 152, a power source part 154 configured to accumulate energy of the carrier wave rectified by the rectification part 153 so as to make it a driving power source, a clock extraction part 156 configured to extract a clock signal from the carrier wave received by the loop antenna 152 and to supply it to a control part 155, a memory part 157 that can store predetermined information signals, a modem part 158 connected to the loop antenna 152, and the control part 155 configured to control operation of the RFID circuit elements To-W, To-R through the rectification part 153, the clock extraction part 156, the modem part 158 and the like.

The modem part 158 demodulates a communication signal from the loop antenna LC of the apparatus 1 for producing RFID labels received by the loop antenna 152 and modulates and reflects the carrier wave received from the loop antenna 152 based on a reply signal from the control part 155.

The control part 155 executes basic control such as interpretation of a received signal demodulated by the modem part 158, generation of a reply signal based on the information signal stored in the memory part 157, reply of it by the modem part 158 and the like.

Figure 10A:
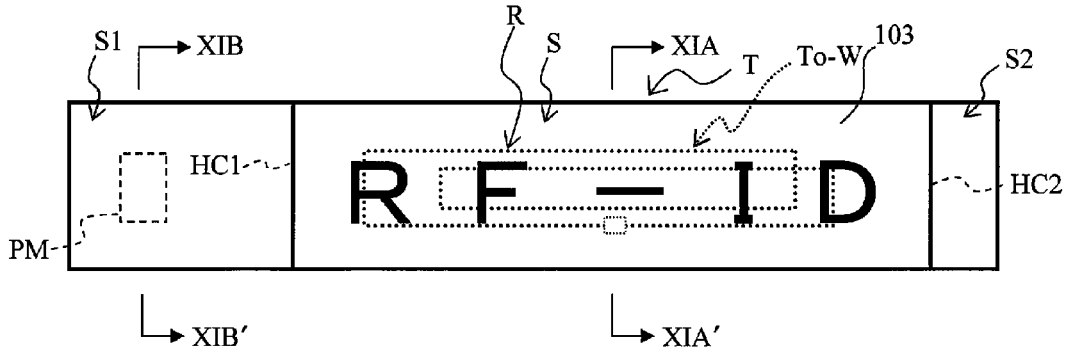
FIGS. 10A and 10B are a top view and a bottom view illustrating an example of an appearance of a RFID label formed by completing information writing (or reading) of the RFID circuit element and cutting of a tag label tape with print by the apparatus for producing RFID labels.
Figure 10B:
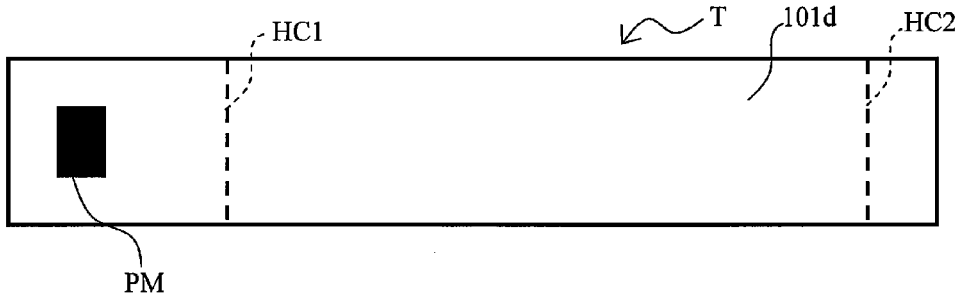
Figure 11A:
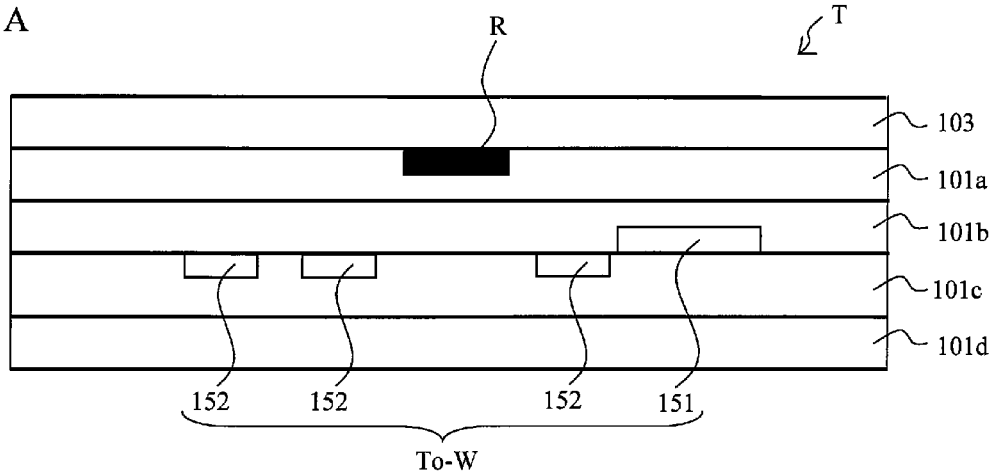

FIGS. 10A and 10B are views illustrating an example of an appearance of the RFID label T (label) formed by completing the information writing (or reading) of the RFID circuit element To-W for a label production and cutting of the tag label tape 109 with print by the apparatus 1 for producing RFID labels with configuration as above, in which FIG. 10A is a top view and FIG. 10B is a bottom view. FIG. 11A is a view obtained by rotating the cross sectional view by XIA-XIA' section in FIG. 10A counterclockwise by 90°, and FIG. 11B is a view obtained by rotating the cross sectional view by XIB-XIB' section in FIG. 10A counterclockwise by 90°.

Figure 11B:
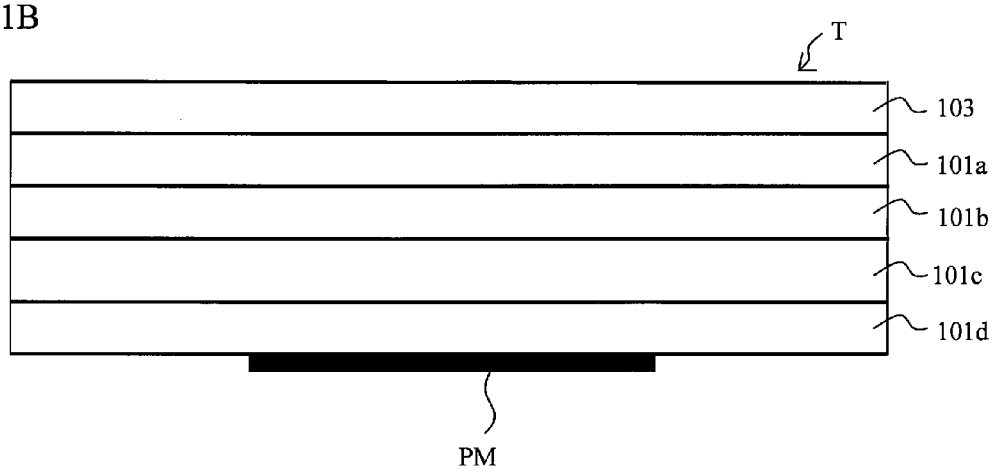

In FIGS. 10A, 10B, 11A, and 11B, the RFID label T is in the five-layered structure in which the cover film 103 is added to the four-layered structure shown in FIG. 5 as mentioned above, and the five layers are constituted by the cover film 103, the adhesive layer 101*a*, the base film 101*b*, the adhesive layer 101*c*, and the separation sheet 101*d* from the side of the cover film 103 (upper side in FIG. 11) to the opposite side (lower side in FIG. 11). Further, the RFID circuit element To-W for a label production including the loop antenna 152 provided on the back side of the base film 101*b* as mentioned above is provided in the base film 101*b* and the adhesive layer 101*c*, and a label print R (characters of "RF-ID" representing the type of the RFID label T in this embodiment) corresponding to stored information and the like of the RFID circuit element To-W for a label production is printed on the back face of the cover film 103.

Also, in the cover film 103, the adhesive layer 101*a*, the base film 101*b*, and the adhesive layer 101*c*, a half-cut line HC (half-cut portion. Two lines of a front half-cut line HC1 and a rear half-cut line HC2 in this embodiment) are formed by the half-cutter 34 substantially along the tape width direction as mentioned above. In the cover film 103, a region held between the half-cut lines HC1, HC2 becomes a print area S on which the label print R is printed, and both sides in the tape longitudinal direction from the print area S1 with the half-cut lines HC1, HC2 held between them are front margin area S1 and a rear margin area S2, respectively. In other words, the front and rear margin areas S1, S2 and the print area S of the cover film 103 are divided by the half-cut lines HC1, HC2.

Figure 11C:
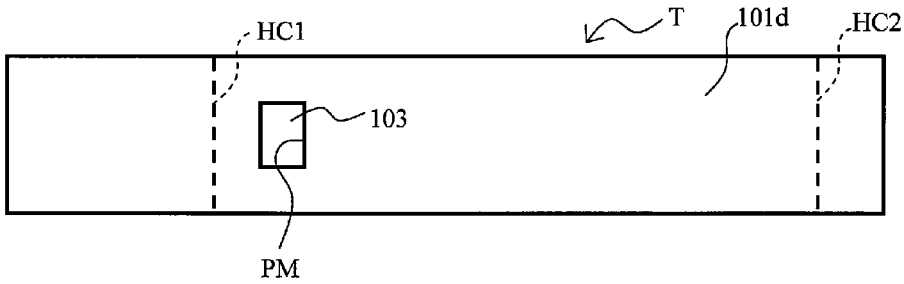

As already mentioned, instead of provision of marking painted in black as the identification mark PM as shown in FIGS. 11A and 11B, a hole substantially penetrating the base tape 101 can be drilled as the identification mark PM as shown in FIG. 11C by Thomson-type or Vic-type punching or laser machining or the like. In this case, if the mark sensor 127 is configured by a known reflection type photoelectric sensor made of a light projector and a light receiver, when the identification mark PM made of the above hole comes to a position between the light projector and the light receiver, the light from the light projector transmits the hole of the identification mark PM and the transparent cover film 103 and stops reflection, and the light is no longer received by the light receiver, by which the control output from the light receiver is reversed.

FIG. 12 is a view illustrating an example of a screen displayed on the PC 118 (terminal 118*a* or general-purpose computer 118*b*) at an access (reading or writing) to the RFID tag information of the IC circuit part 151 of the RFID circuit element To-W for a label production by the apparatus 1 for producing RFID labels as mentioned above.

In FIG. 12, in this example, a type of the tag label (access frequency and tape dimension), print character R printed in correspondence with the RFID circuit element To-W for a label production, an access (reading or writing) ID as identification information (tag ID) specific to the RFID circuit element To-W, an address of article information stored in the information server IS, storage destination address of information corresponding to them in the route server RS and the like can be displayed on the PC 118. Then, when the apparatus 1 for producing RFID labels is operated by operation of the PC 118, the print character R is printed on the cover film 103 and information including the writing ID and the article information is written on the IC circuit part 151 (or the information such as reading ID and article information stored in the IC circuit part 151 in advance is read out).

At the above reading or writing, correspondence between the RFID circuit element To-W for a label production of the produced RFID label T and the information read out of the IC circuit part 151 of the RFID label T (or the information written in the IC circuit part 151) is stored in the above-mentioned route server RS so that it can be referred to later as necessary.

In the apparatus 1 for producing RFID labels having the basic configuration as above, control is made so that a scan mode in which information is usually transmitted/received with respect to the RFID circuit element To-R for an information reading located outside the apparatus main body 2 (housing 200) through the loop antenna LC by the control circuit 110 is brought about and if a label production instruction is given by an operator, control is made so that the mode is changed to a tag-label production mode in which the information is transmitted/received with respect to the RFID circuit element To-W for a label production provided at the tag label tape 109 with print. In this tag-label production mode, the information reading or writing has been carried out for the RFID circuit element To-W for a label production by the loop antenna LC to the tag label tape 109 with print produced by bonding, the tag label tape 109 with print is cut by the cutting mechanism 15, and the RFID label T is produced.

Figure 13:
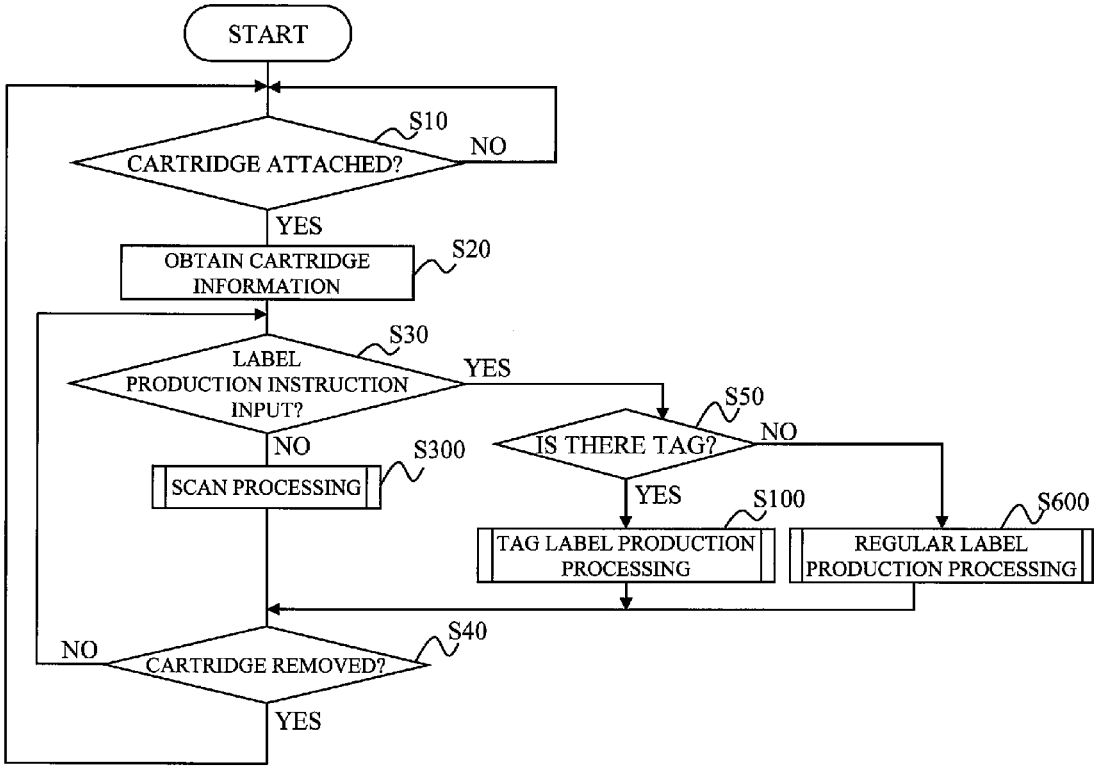
FIG. 13 is a flowchart illustrating a control procedure executed by a control circuit.

FIG. 13 is a flowchart illustrating a control procedure executed by the control circuit 110 in order to carry out the above control. This flow is started when the apparatus 1 for producing RFID labels is powered on.

First, at step 10, it is determined if the cartridge 7 has been attached to the cartridge holder 6 or not. This determination is made by determining if a detection signal has been input from the cartridge sensor 81 or not. This Step 10 is repeated till the cartridge 7 is attached to the cartridge holder 6, and when attached, the determination is satisfied, and the routine goes to the subsequent Step S20.

At Step 20, an access is made to the information server IS through the communication line NW, and cartridge information of the cartridge 7 (whether the cartridge 7 is for a tag label production or for an usual label production not having a tag and in the case of the tag label production, tag ID information of all the RFID circuit element To-W for a label production present in the cartridge and the like) is obtained based on a detection signal input from the cartridge sensor 81.

At the subsequent Step S30, it is determined if an instruction for a label production has been input from the operator, that is, if an operation signal for a label production has been input from the PC 118 and the like through the communication line NW and the input/output interface 113 or not, for example. If there is no instruction input (that is, in the usual case), the determination is not satisfied, and the routine goes to the subsequent Step S300.

At Step S300, the mode is changed to the scan mode, in which radio communication is performed to the RFID circuit element To-R for an information reading located outside the apparatus main body 2 (housing 200) through the loop antenna LC so as to execute scan processing of reading out the information in the RFID circuit element To-R (for details, see FIG. 14, which will be described later).

At the subsequent Step S40, it is determined if the cartridge 7 has been removed from the cartridge holder 6 or not. This determination is made by determining if a detection signal has been input from the cartridge sensor 81 or not. If the cartridge has not been removed, the determination is not satisfied and the routine returns to the preceding Step S30. If the cartridge has been removed, the determination is satisfied, and the routine returns to the first Step S10.

On the other hand, if the instruction for a label production has been input from the operator at Step S30, the determination is satisfied, and the routine goes to the subsequent Step S50. At Step S50, based on the cartridge information obtained at Step S20, it is determined if the cartridge 7 is for a tag label production or for a usual label production not having a tag. If the cartridge 7 is a cartridge for a tag label production, the determination is satisfied and the routine goes to the subsequent Step S100.

At Step S100, the mode is changed to the tag-label production mode, in which tag label production processing to produce the RFID label T is carried out (For details, see FIG. 15, which will be described later). After that, the routine goes to Step S40.

On the other hand, at Step S50, if the cartridge 7 is a cartridge for an usual label production, the determination is not satisfied and the routine goes to Step S600, where the mode is changed to the usual label production mode, in which usual label production processing to produce a usual label not having a tag is carried out (For details, see FIG. 18, which will be described later). After that, the routine goes to Step S40.

Figure 14:
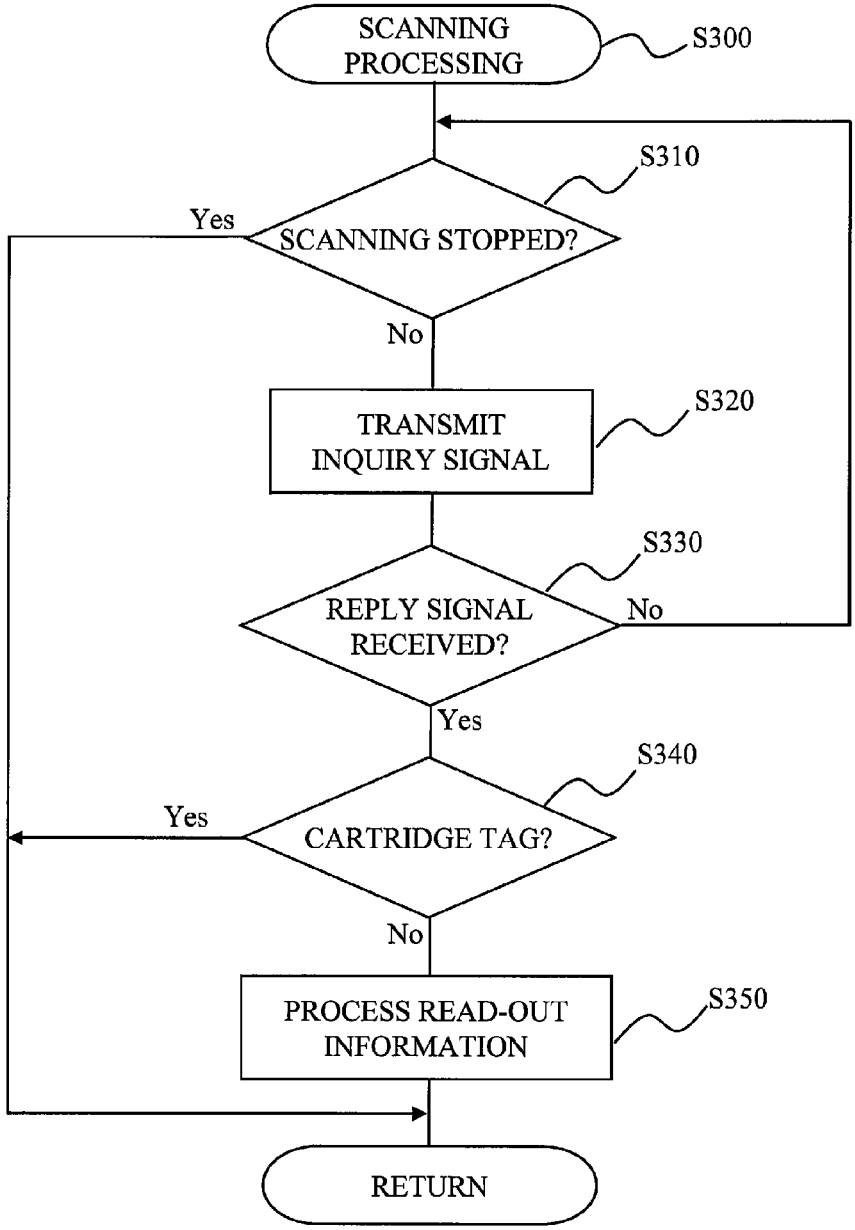
FIG. 14 is a flowchart illustrating a detailed procedure of Step S300.

FIG. 14 is a flowchart illustrating a detailed procedure of the above-mentioned Step S300.

In FIG. 14, first, at Step S310, it is determined if there has been an instruction input to stop scanning from the operator or not, that is, if an operation signal to stop scanning has been input from the PC 118 and the like through the communicating line NW and the input/output interface 113 or not, for example. If there has been an instruction input, this flow is finished. If not, the determination is not satisfied and the routine goes to the subsequent Step S320.

Subsequently, at Step 320, a control signal is output to the transmission circuit 306 and a carrier wave on which predetermined modulation has been performed is transmitted to the RFID circuit element To-R, which is a target for reading, as an inquiry signal for obtaining information stored in the RFID circuit element To-R for an information reading ("Scroll All ID", "Ping" command signals and the like, for example) through the loop antenna LC and reply is prompted.

After that, at Step S330, it is determined if a reply signal from the RFID circuit element To-R as the reading target has been transmitted in correspondence to the inquiry signal and the reply signal has been received through the loop antenna LC or not. If the reply signal has not been received, the routine returns to Step S310, and Step S310 to Step S330 are repeated till the reply signal is received. That is, if there is no RFID circuit element To-R (RFID label T) as the reading target in a communication range of the loop antenna LC outside the apparatus main body 2 (a range of a path of the magnetic path M outside the housing side wall 200A shown in the above-mentioned FIG. 4), the transmission state of the inquiry signal is continued. Then, when the reply signal is received, the determination is satisfied and the routine goes to the subsequent Step S340.

At Step S340, it is determined if the RFID circuit element To-R as the reading target having transmitted the reply signal is the RFID circuit element To-W for a label production provided at the tag label tape 109 with print fed out of the cartridge 7 attached to the cartridge holder 6. This determination is made by comparing the tag ID obtained from the RFID circuit element To-R as the reading target based on the above received reply signal and the tag ID information of all the RFID circuit elements To-W present in the cartridge 7 in the cartridge information obtained at the above-mentioned Step S20. If it is the RFID circuit element To-W for a label production of the cartridge 7, this flow is finished. If it is not the RFID circuit element To-W of the cartridge 7, that is, if it is the RFID circuit element To-R for an information reading outside the apparatus main body 2, the determination is satisfied and the routine goes to the subsequent Step S350.

At Step S350, the RFID tag information obtained from the RFID circuit element To-R as the reading target based on the received reply signal is processed as appropriate. The processing may include, for example, output of the information through the input/output interface 113 and the communication line NW and storage in the information server IS and the route server RS as necessary so as to be referable from the PC 118, display by display device of the PC 118 and the like. Then, this flow is finished.

Though not described here, if information reading is not successful, retry may be made for the predetermined number of times. When the inquiry signal is output from the loop antenna LC, its transmission output may be larger than the case of the tag label production processing at Step S100.

Figure 15:
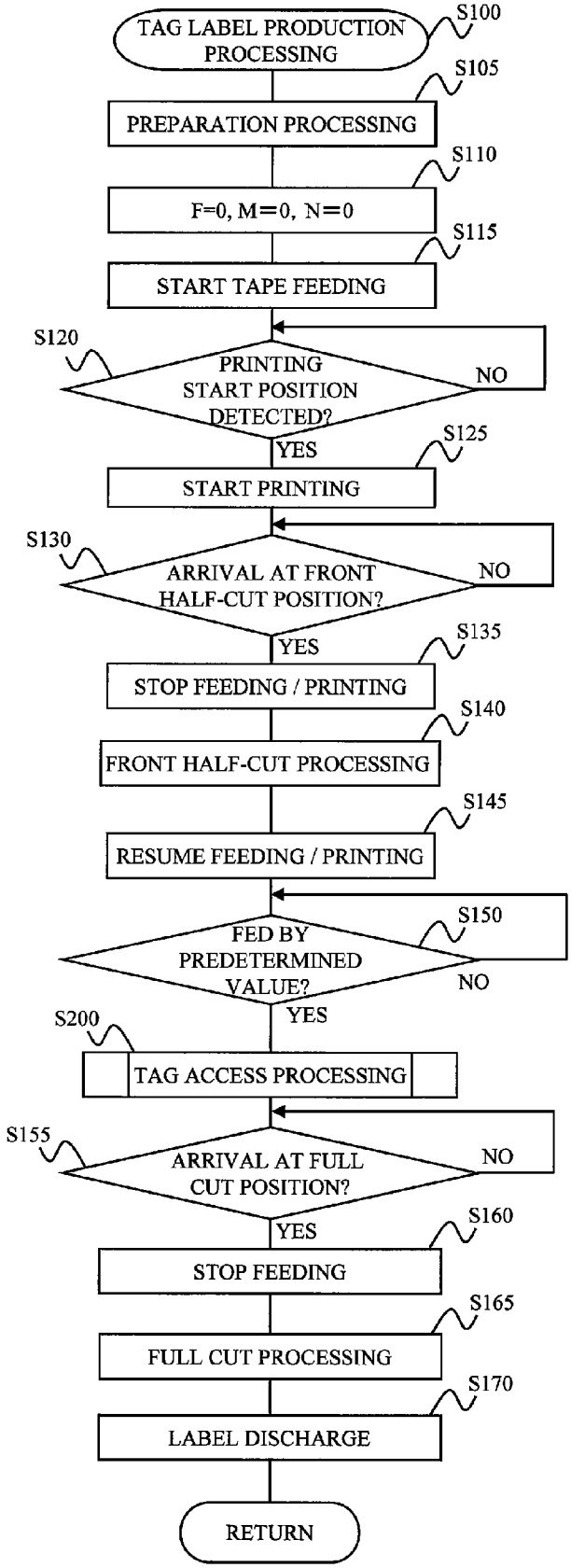
FIG. 15 is a flowchart illustrating a detailed procedure of Step S100.

FIG. 15 is a flowchart illustrating a detailed procedure of the above-mentioned Step S100.

First at Step S105, preparation processing such as setting of print data, communication data with the RFID circuit element To-W for a label production, front/rear half-cut positions, full-cut positions and the like is carried out based on the operation signal from the PC 118.

Subsequently, at Step S110, at communication from the loop antenna LC to the RFID circuit element To-W for a label production, variables M, N for counting the number of times (access retry times) of communication retries when there is no response from the RFID circuit element To-W and a flag F indicating if the communication was successful or not are initialized to zero.

After that, the routine goes to Step S115, in which a control signal is output to the feeding motor driving circuit 121 through the input/output interface 113 so as to rotate and drive the feeding roller 27 and the ribbon take-up roller 106 by a driving force of the feeding motor 121. Moreover, a control signal is output to the tape discharge motor 65 through the tape discharge motor driving circuit 123 so as to rotate and drive the driving roller 51. As a result, the base tape 101 is fed out of the first roll 102 and supplied to the feeding roller 27 and at the same time the cover film 103 is fed out of the second roll 104, and the base tape 101 and the cover film 103 are bonded and integrated by the feeding roller 27 and a sub roller 109 to be formed as the tag label tape 109 with print, which is further fed from the direction outside the cartridge 7 to the direction outside the apparatus 1 for producing RFID labels.

After that, at Step S120, based on a detection signal of the mark detection sensor 127 input through the input/output interface 113, it is determined if the identifier PM of the base tape 101 has been detected or not (in other words, if the cover film 103 has reached a printing start position by the print head 23 or not). This procedure is repeated till the identifier PM is detected and the determination is satisfied, while upon detection, the determination is satisfied and the routine goes to the subsequent Step S125.

At Step S125, a control signal is output to the print-head driving circuit 120 through the input/output interface 113, the print head 23 is electrified, and print of the label print R including characters, symbols, barcodes and the like corresponding to the print data generated at Step S105 is started on the above-mentioned print area S (=area to be bonded substantially on the back face of the RFID circuit element To-W arranged on the base tape 101 with an equal interval and a predetermined pitch) in the cover film 103.

After that, at Step S130, it is determined if the tag label tape 109 with print has been fed to a front half-cut position set at the preceding Step S105 or not (in other words, if the tag label tape 109 with print has reached a position where the half-cutter 34 of the half-cut mechanism 35 is opposed to the front half-cut line HC1 set at Step S1 or not). The determination at this time may be made by detecting a feeding distance after the identifier PM of the base tape 101 is detected at Step S120 by a predetermined known method (such as counting the number of pulses output by the feeding motor driving circuit 121 driving the feeding motor 119, which is a pulse motor). This procedure is repeated till the front half-cut position is reached and the determination is satisfied, and if reached, the determination is satisfied and the routine goes to the subsequent Step S135.

At Step S135, a control signal is output to the feeding motor driving circuit 121 and the tape discharge motor driving circuit 123 through the input/output interface 113 so as to stop driving of the feeding motor 119 and the tape discharge motor 65, and rotation of the feeding roller 27, the ribbon take-up roller 106 and the driving roller 51 is stopped. As a result, during the course in which the tag label tape 109 with print fed out of the cartridge 7 is moved in the discharge direction, in the state where the half-cutter 34 of the half-cut mechanism 35 is opposed to the front half-cut line HC1 set at Step S105, feeding-out of the base tape 101 from the first roll 102, feeding-out of the cover film 103 from the second roll 104, and feeding of the tag label tape 109 with print are stopped. Also, at this time, a control signal is output to the print-head driving circuit 120 through the input/output interface 113, electricity to the print head 23 is stopped, and printing of the label print R is stopped (printing interrupted).

After that, at Step S140, the front half-cut processing is carried out in which a control signal is output to the half-cutter motor driving circuit 128 through the input/output interface 113 so as to drive the half-cutter motor 129 and rotate the half-cutter 34, and the cover film 103, the adhesive layer 101*a*, the base film 101*b* and the adhesive layer 101*c* of the tag label tape 109 with print are cut so as to form the front half-cut line HC1.

Then, the routine goes on to Step S145, where the feeding roller 27, the ribbon take-up roller 106, and the driving roller 51 are rotated/driven similarly to Step S115 so as to resume feeding of the tag label tape 109 with print, and the print head 23 is electrified as in Step S125 so as to resume printing of the label print R.

After that, at Step S150, it is determined if the tag label tape 109 with print while being fed has been fed by a predetermined value (such as a feeding distance by which the RFID circuit element To-W in which the cover film 103 with corresponding print applied is bonded has reached the loop antenna LC) or not. The feeding distance determination at this time may be also made by counting the number of pulses output by the feeding motor driving circuit 121 driving the feeding motor 119, which is a pulse motor, similarly to the Step S130.

At the subsequent Step S200, tag access processing is carried out. That is, if having been fed to a communication position of the RFID circuit element To-W (position where the RFID circuit element To-W is opposed to the loop antenna LC), the feeding and print are stopped for information transmission/reception, and then, the feeding and print are resumed so as to complete print, and further feeding is carried out and stopped at a rear half-cut position so as to form a rear half-cut line HC2 (See FIG. 16, which will be described later).

When Step S200 is finished as mentioned above, the routine goes to Step S155 (at this time, feeding of the tag label tape 109 with print has been already resumed at Step S200). At Step S155, it is determined if the tag label tape 109 with print has been fed to the above-mentioned full-cut position or not (in other words, if the tag label tape 109 with print has reached a position where the movable blade 41 of the cutting mechanism 15 is opposed to a cutting line CL set at Step S1). The determination at this time may be also made by detecting the feeding distance after the identifier PM of the base tape 101 is detected at Step S120 similarly to the above (by counting the number of pulses output by the feeding motor driving circuit 121 driving the feeding motor 119, which is a pulse motor), for example. This procedure is repeated till the full-cut position is reached and the determination is satisfied, and if reached, the determination is satisfied and the routine goes to the subsequent Step S1160.

At Step S160, similarly to the above Step S135, rotation of the feeding roller 27, the ribbon take-up roller 106 and the driving roller 51 is stopped. As a result, in the state where the movable blade 41 of the cutting mechanism 15 is opposed to the cutting line CL set at Step S105, feeding-out of the base tape 101 from the first roll 102, feeding-out of the cover film 103 from the second roll 104, and feeding of the tag label tape 109 with print are stopped.

After that, at Step S165, a control signal is output to the cutter motor driving circuit 122 so as to carry out full-cut processing to form the cutting line CL by driving the cutter motor 43, rotating the movable blade 41 of the cutting mechanism 15, and cutting (separating) all the cover film 103, the adhesive layer 101*a*, the base film 101*b*, the adhesive layer 101*c*, and the separation sheet 101*d* of the tag label tape 109 with print. By the separation by the cutting mechanism 15, the RFID label T in the label state cut away from the tag label tape 109 with print is produced, in which the RFID tag information of the RFID circuit element To-W for a label production is written (or the predetermined RFID tag information is read out of the RFID circuit element To-W for a label production) and corresponding desired print is applied.

After that, the routine goes to Step S170, where a control signal is output to the tape discharge motor driving circuit 123 through the input/output interface 113 so as to resume the driving of the tape discharge motor 65, and the driving roller 51 is rotated. As a result, the feeding by the driving roller 51 is resumed, the RFID label T produced in the label state at Step S165 is fed toward the label carry-out exit 11 and discharged out of the label carry-out exit 11 to outside the apparatus 1 for producing RFID labels, and this flow is finished.

Figure 16:
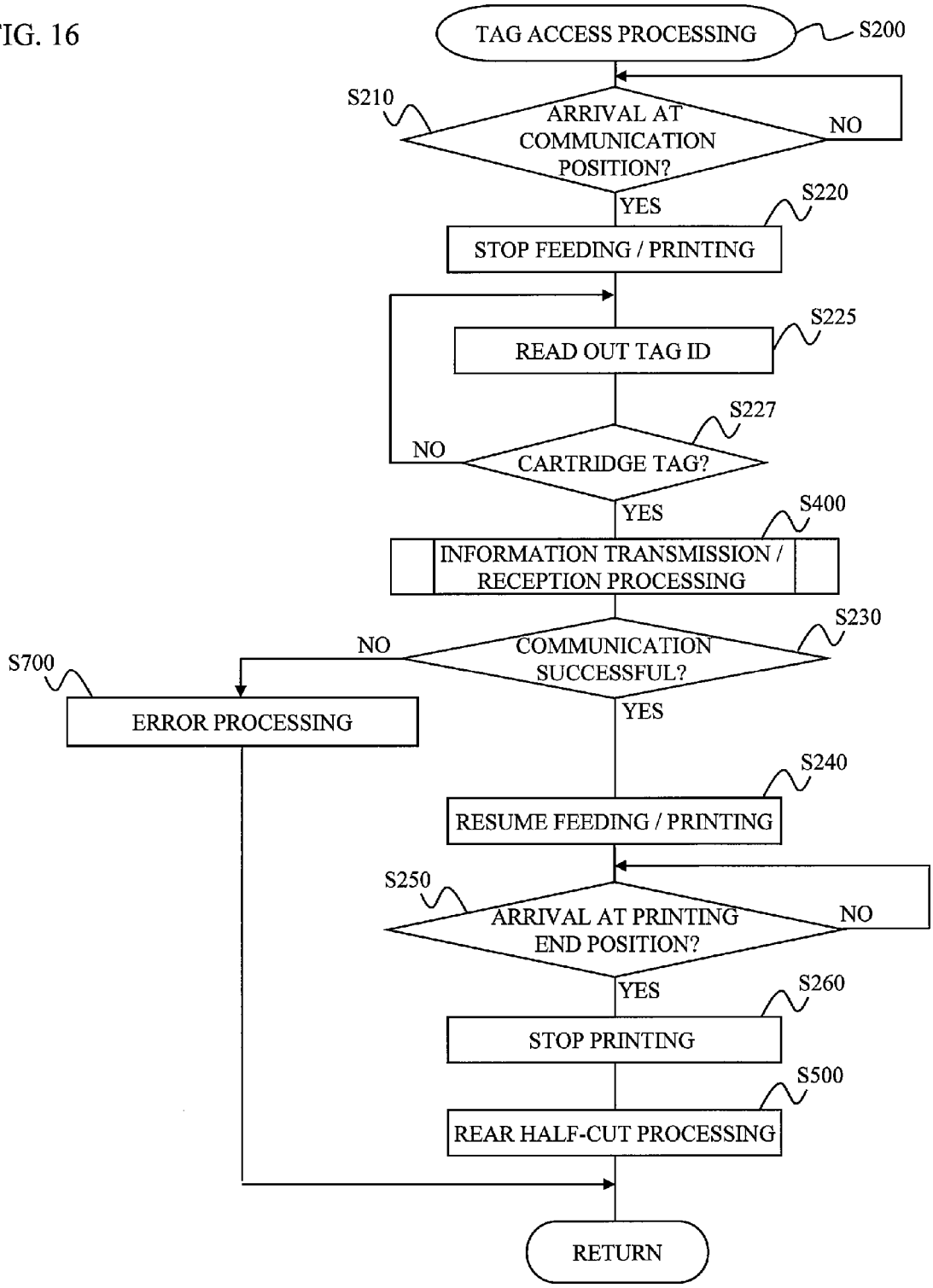
FIG. 16 is a flowchart illustrating a detailed procedure of Step S200.

FIG. 16 is a flowchart illustrating a detailed procedure of the above-mentioned Step S200. First, at Step S210, it is determined if the tag label tape 109 with print has been fed to the above-mentioned communication position with the loop antenna LC. The determination at this time may be also made by detecting the feeding distance after the identifier PM of the base tape 101 is detected at Step S120 by a predetermined known method, for example, similarly to the above-mentioned Step S130 in FIG. 15. This procedure is repeated till the communication position is reached and the determination is satisfied, and if reached, the determination is satisfied and the routine goes to the subsequent Step S220.

At Step S220, similarly to Step S135, rotation of the feeding roller 27, the ribbon take-up roller 106 and the driving roller 51 is stopped, and feeding of the tag label tape 109 with print is stopped in the state where the RFID circuit element To-W for a label production is substantially opposed to the loop antenna LC. Also, electricity to the print head 23 is stopped, and printing of the label print R is stopped (interrupted).

At the subsequent Step S225, a control signal is output to the transmission circuit 306, and as an inquiry signal to obtain identification information (tag ID) stored in the RFID circuit element To-W ("Scroll All ID", "Ping" command signals and the like, for example), a carrier wave on which predetermined modulation has been performed is transmitted to the RFID circuit element To-W as a communication target through the loop antenna LC, a reply signal transmitted from the RFID circuit element To-W in correspondence with that is received through the loop antenna LC, and the tag ID of the RFID circuit element To-W as the communication target is obtained.

At the subsequent Step S227, it is determined if the RFID circuit element To-W as the communication target is the RFID circuit element To-W provided at the tag label tape 109 with print fed out of the cartridge 7 attached to the cartridge holder 6 or not. This determination is made by comparing the tag ID obtained from the RFID circuit element To-W and the tag ID information of all the RFID circuit elements To-W for a label production present in the cartridge 7 in the cartridge information obtained at the above-mentioned Step S20. If it is not the RFID circuit element To-W of the cartridge 7, the determination is not satisfied and the routine returns to Step S225. On the other hand, if it is the RFID circuit element To-W of the cartridge 7, the routine goes to the subsequent Step S400.

At Step S400, information transmission/reception processing is carried out in which information is transmitted/received via radio communication between the antenna LC and the RFID circuit element To-W so as to write information prepared at Step S1105 in FIG. 15 (or reading information stored in the IC circuit part in advance) with respect to the IC circuit part 151 of the RFID circuit element To-W (For details, see FIG. 17, which will be described later).

After that, the routine goes to Step S230, where it is determined if information transmission/reception has been successful at Step S400 or not. Specifically, at Step S400, it is determined if F=0 or not, since it should be such that the flag F=1 in the case of communication failure at Step S400 (See Step S437 in FIG. 17, which will be described later).

In the case of F=1, the determination is not satisfied, the communication to the RFID circuit element To-W is considered to be failed, the routine goes on to Step S700, and error processing for notifying the communication failure on the label (such as printing of another mode print R' (characters of "NG", for example) corresponding to the communication error, for example) to the operator is carried out, and this routine is finished.

On the other hand, in the case of F=0, the determination is satisfied, the communication to the RFID circuit element To-W is considered to be successful, and the routine goes on to Step S240.

At Step S240, similarly to Step S145 in FIG. 15, the feeding roller 27, the ribbon take-up roller 106, and the driving roller 51 are rotated/driven and feeding of the tag label tape 109 with print is resumed, and printing of the label print R is resumed by electrifying the print head 23.

At this time, if the electricity stopped period of the print head 23 becomes longer than a predetermined time after Step S220 because the number of communication retry times (retry times) at Step S400 is large or the like, there is a possibility that the temperature of the print head 23 is lowered. Thus, in order to cope with this, at resumption of the printing at Step S240, electricity to the print head 23 (energy amount per unit time) may be made larger than usual.

After that, the routine goes on to Step S250, where it is determined if the tag label tape 109 with print has been fed to the above-mentioned printing end position (calculated at Step S105 in FIG. 15) or not. The determination at this time can be also made by detecting a feeding distance after the identifier PM of the base tape 101 is detected at Step S120 by a predetermined known method, for example, as in the above. This procedure is repeated till the printing end position is reached and the determination is satisfied, and when reached, the determination is satisfied and the routine goes on to the subsequent Step S260.

At Step S260, similarly to Step S135 in FIG. 15, electricity to the print head 23 is stopped, and the printing of the label print R is stopped. As a result, the printing of the label print R on the print area S is completed.

After that, the routine goes to Step S500, where after the tape is fed to a predetermined rear half-cut position, rear half-cut processing is carried out so as to form the rear half-cut line HC2 by the half-cutter 34 of the half-cut unit 35. Then, this routine is finished.

Figure 17:
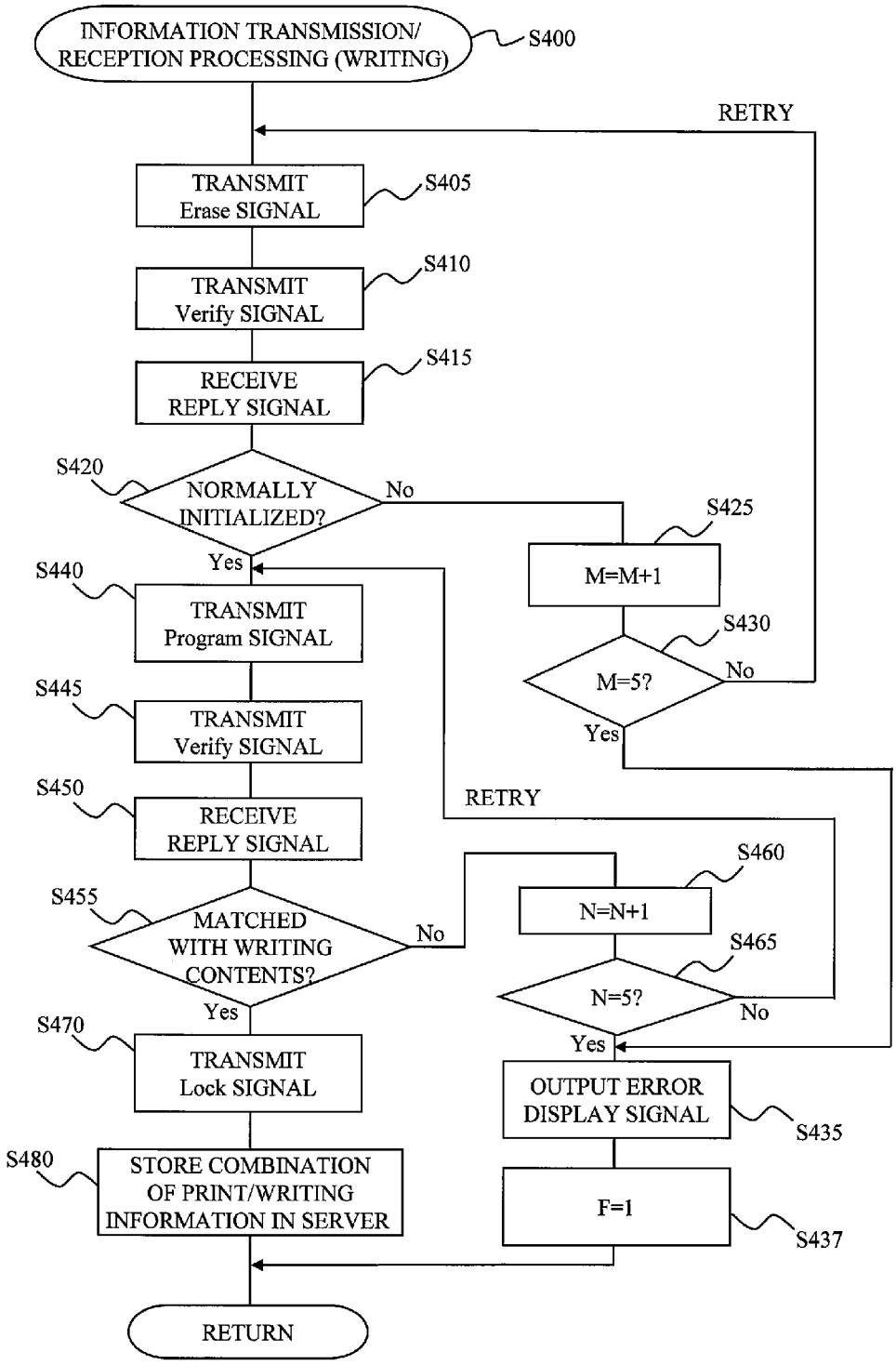
FIG. 17 is a flowchart illustrating a detailed procedure of Step S400.

FIG. 17 is a flowchart illustrating a detailed procedure of the above-mentioned Step S400. In this embodiment, information writing in the above-mentioned information writing and information reading will be described as an example.

First, at Step S405 in the flow shown in FIG. 17, a control signal is output to the above-mentioned transmission circuit 306 through the input/output interface 113 and as an "Erase" command signal to initialize information stored in the memory part 157 in the RFID circuit element To-W, a carrier wave on which predetermined modulation has been performed is transmitted to the RFID circuit element To-W as the writing target through the loop antenna LC. As a result, the memory part 157 of the RFID circuit element To-W is initialized.

Subsequently, at Step S410, a control signal is output to the transmission circuit 306 through the input/output interface 113 and as a "Verify" command signal to verify contents of the memory part 157, a carrier wave on which predetermined modulation has been performed is transmitted to the RFID circuit element To-W as the information writing target through the loop antenna LC and a reply is prompted.

After that, at Step S415, a reply signal transmitted from the RFID circuit element To-W as the writing target in correspondence with the "Verify" command signal is received through the loop antenna LC and taken in through the receiving circuit 307 and the input/output interface 113.

Subsequently, at Step S420, on the basis of the received reply signal, information in the memory part 157 of the RFID circuit element To-W is verified so as to determine if the memory part 157 is normally initialized or not.

If the determination is not satisfied, the routine goes on to Step S425, where one is added to M, and it is determined if M=5 or not at Step S430. In the case of M≦4, the determination is not satisfied but the routine returns to Step S405 and the same procedure is repeated. In the case of M=5, the routine goes on to Step S435, where an error display signal is output to the PC 118 through the input/output interface 113 so that corresponding writing failure (error) display is made and moreover, the above mentioned flag F=1 is set at step S437 and this routine is finished. In this way, even if initialization is not successful, retry is made up to five times.

If the determination at Step S420 is satisfied, the routine goes on to step S440, where a control signal is output to the transmission circuit 306, and the carrier wave on which predetermined modulation has been performed is transmitted to the RFID circuit element To-W as information writing target through the loop antenna LC as a "Program" command signal for writing desired data in the memory part 157 and the information is written.

After that, at Step S445, a control signal is output to the transmission circuit 306, the carrier wave on which predetermined modulation has been performed as the "Verify" command signal is transmitted to the RFID circuit element To-W as information writing target through the loop antenna LC, and a reply is prompted. After that, at Step S450, the reply signal transmitted from the RFID circuit element To-W as writing target in correspondence with the "Verify" command signal is received through the loop antenna 305 and taken in by the receiving circuit 307.

Subsequently, at Step S455, on the basis of the received reply signal, the information stored in the memory part 157 of the RFID circuit element To-W is verified and it is determined if the above-mentioned transmitted predetermined information is normally stored in the memory part 157 or not using a known error detection code (CRC code: Cyclic Redundancy Check or the like).

If the determination is not satisfied, the routine goes to Step S460, where one is added to N, and it is further determined at Step S465 if it is N=5 or not. In the case of N≦4, the determination is not satisfied and the routine returns to Step S440, where the same procedure is repeated. In the case of N=5, the routine goes on to Step S435, where a corresponding writing failure (error) display is similarly made to the PC 118, the above-mentioned flag F=1 is set at step S437, and this routine is finished. In this way, even if information writing is not successful, retry is made up to five times.

If the determination at Step S455 is satisfied, the routine goes on to step S470, where a control signal is output to the transmission circuit 306, and the carrier wave on which predetermined modulation has been performed as a "Lock" command is transmitted to the RFID circuit element To-W as information writing target through the loop antenna LC so as to prohibit new information writing in the RFID circuit element To-W. As a result, writing of the RFID tag information in the RFID circuit element To-W as writing target is finished.

After that, the routine goes on to Step S480, and combination of the information written in the RFID circuit element To-W at Step S440 and the print information of the label print R already printed on the print area S by the print head 23 in correspondence with that is output through the input/output interface 113 and the communication line NW and stored in the information server IS and the route server RS. This stored data is stored/held in the database of each of the servers IS, RS so that it can be referred to by the PC 118 as necessary, for example. Then, this routine is finished.

In this flow, when the "Erase", "Verify", "Program" command signals and the like are output from the loop antenna LC, a transmission output may be made smaller than that in the case of the scan processing at Step S300.

Here, the case where the RFID tag information is transmitted to the RFID circuit element To-W and written in the IC circuit part 151 so as to produce the RFID label T has been described, but not limited to that. That is, while the RFID tag information is read out of the RFID circuit element To for read only in which predetermined RFID tag information is stored and held in advance unrewritably, the RFID label T may be produced by making a corresponding print.

Figure 18:
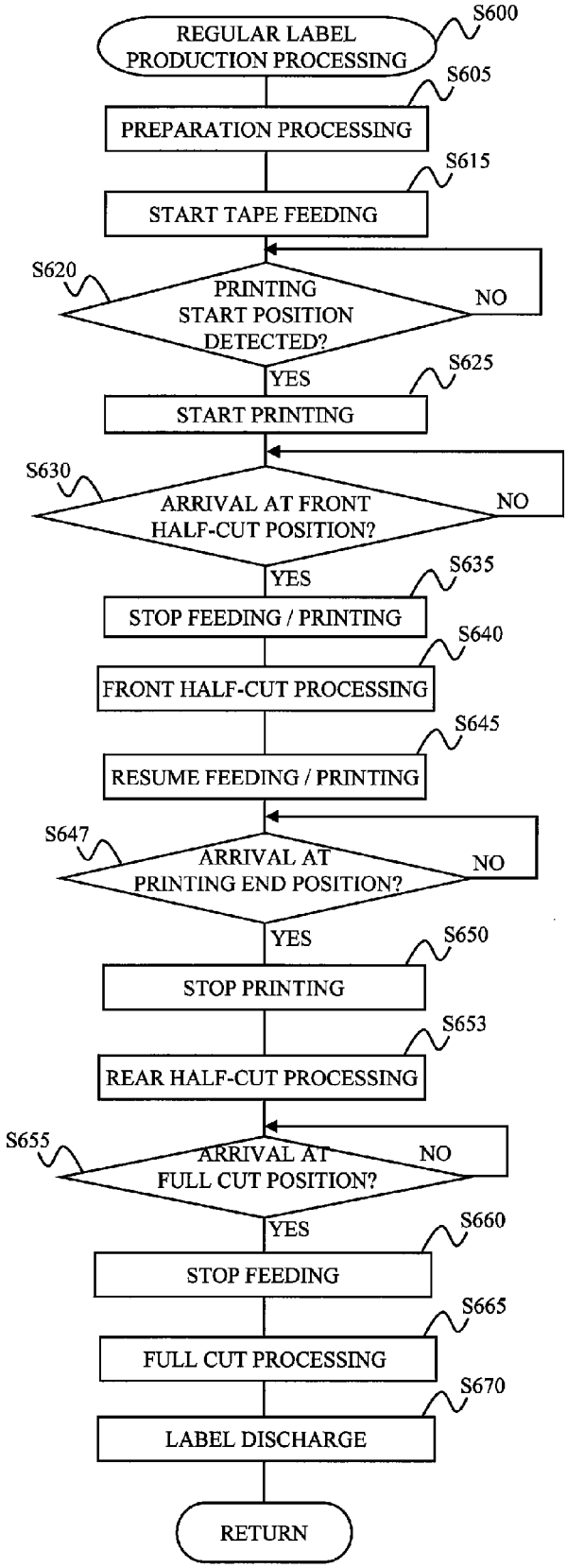
FIG. 18 is a flowchart illustrating a detailed procedure of Step S600.

FIG. 18 is a flowchart illustrating a detailed procedure of the above-mentioned Step S600.

First at Step S605, preparation processing is carried out for setting print data, front/rear half-cut positions, full-cut position and the like is executed based on the operation signal from the PC 118.

Since the subsequent Step S605 to Step S645 are similar to Step S15 to Step S145 in the above-mentioned FIG. 15, the description will be omitted.

At Step S647, similarly to step S250 in the above-mentioned FIG. 16, it is determined if the tag label tape 109 with print has been fed to the printing end position (calculated at Step S605) or not. This procedure is repeated till the printing end position is reached and the determination is satisfied, and when reached, the determination is satisfied and the routine goes on to the subsequent Step S650.

At Step S650, similarly to Step S260 in the above-mentioned FIG. 16, electricity to the print head 23 is stopped, and the printing of the label print R is stopped. As a result, the printing of the label print R on the print area S is completed.

At the subsequent Step S653, after the tape has been fed to a predetermined rear half-cut position, the rear half-cut processing is carried out in which the rear half-cut line HC2 is formed by the half-cutter 34 of the half-cut unit 35.

After that, since Step S655 to Step S670 are the same as Step S155 to Step S170 in the above-mentioned FIG. 15, the description will be omitted. Then, this flow is finished.

As mentioned above, the procedure of Step S330 executed by the control circuit 110 constitutes an information acquisition portion configured to obtain RFID tag information provided at the IC circuit part of the RFID circuit element described in claim 10. Also, the procedures of Step S340 and Step S227 executed by the control circuit 110 constitute prohibition processing portion described in claim 10. Also, the procedure of Step S125 executed by the control circuit 110 constitutes first print-control portion configured to operate the printing device described in claim 12.

In the embodiment described above, the loop antenna LC is provided with communicable regions both inside and outside of the housing 200 of the apparatus main body 2. With this configuration, information transmission/reception can be carried out with the RFID circuit element To-R for an information reading located outside the housing and if the RFID circuit element To-W for a label production is provided at the tag label tape 109 with print fed by the driving roller 51, the information transmission/reception can be carried out also with the RFID circuit element To-W fed inside the housing. Since the information transmission/reception with the RFID circuit element To-R for an information reading outside the housing and processing inside the housing can be both carried out with a single apparatus, versatility of the apparatus for communicating with a RFID tag can be improved. Also, as compared with the case of execution by separate apparatuses, equipment configuration can be simplified, and rapid processing can be realized while assuredness/reliability of operation are improved.

Particularly in this embodiment, by providing a single loop antenna LC having communicable regions both inside and outside the housing 200, information writing or reading via radio communication is enabled both with the RFID circuit element To-W for a label production provided at the tag label tape 109 with print and the RFID circuit element To-R for an information reading located outside the apparatus main body 2 (housing 200). With this configuration, as compared with execution with separate apparatuses (outside communication device, inside communication device), respectively, equipment configuration can be simplified, and rapid processing can be realized while assuredness/reliability of operation are improved.

Particularly in this embodiment, control is executed by the control circuit 110 through switching between the scan mode in which the information is transmitted/received with the RFID circuit element To-R for an information reading located outside the apparatus main body 2 (housing 200) through the loop antenna LC and the tag-label production mode in which the information is transmitted/received with the RFID circuit element To-W for a label production provided at the tag label tape 109 with print. As mentioned above, since the control circuit 110 is provided with a communication function to the RFID circuit element To-R for an information reading outside the housing and the communication function with the RFID circuit element To-W for a label production inside the housing as modes in advance, the communication function can be switched easily and smoothly only by switching control between the scan mode and the tag-label production mode.

Particularly in this embodiment, control is executed by the control circuit 110 in correspondence with the scan mode in a usual time and in the tag-label production mode (or usual label production mode) when a label production instruction is given by an operator. By realizing the communication function with the RFID circuit element To-R for an information reading outside the housing as the scan mode in a usual state and by realizing the communication function with the RFID circuit element To-W for a label production in the housing as the tag-label production mode as necessary in tag label production as mentioned above, switching between the both modes can be realized with a required minimum operation, by which convenience for the operator can be improved. Also, since the loop antenna LC that carries out radio communication with the RFID circuit element To-W for a label production, which becomes unnecessary when a tag label is not produced and a command information generation function (including the transmission/reception circuits 306, 307) that generates command information among the functions of the control circuit 110 can be used for scanning, there is an advantage that the devices are not left idle but can be effectively used.

Also, particularly in this embodiment, the cartridge information (tag ID information of all the RFID circuit elements To-W for a label production present in the cartridge and the like) of the cartridge 7 is obtained in advance, and if the tag ID of the RFID circuit element To-W for a label production provided at the tag label tape 109 with print is obtained through the loop antenna LC during control in the scan mode, the scan procedure is stopped, while if the tag ID of the RFID circuit element To-R for an information reading located outside the housing is obtained through the loop antenna LC during control in the tag-label production mode, the tag label production processing is prohibited. As a result, wrong communication/interference with the RFID circuit element To-W in the housing in the scan mode with the RFID circuit element To-R outside the housing as the communication target can be prevented, and the wrong communication/interference with the RFID circuit element To-R outside the housing in the tag-label production mode with the RFID circuit element To-W inside the housing as the communication target can be also prevented.

Particularly in this embodiment, by detecting the portion 190 to be detected provided at the cartridge housing 7A by the cartridge sensor 81, the cartridge information of the cartridge 7 is obtained. Then, according to the detection result, the wrong communication/interference with the RFID circuit element To, which is not a communication target by nature as described above, is prevented. By obtaining the information to be criteria on whether it is a communication target or not from the cartridge side, more smooth and certain prohibition processing can be carried out.

Note that, the present invention is not limited to the above embodiment but various variations are possible in a range not departing from its gist and technical scope. The variations will be described below in order.

(1) When Two Antennas are Used:

(i) When Antennas are not Switched:

In the above embodiment, the communicable regions are provided both inside and outside the housing 200 of the apparatus main body 2 by the single loop antenna LC, but not limited to that, the communicable regions may be provided both inside and outside the housing 200 using two antennas. This variation is an example in which the antenna is not switched at mode switching between the scan mode and the tag-label production mode.

Figure 19:
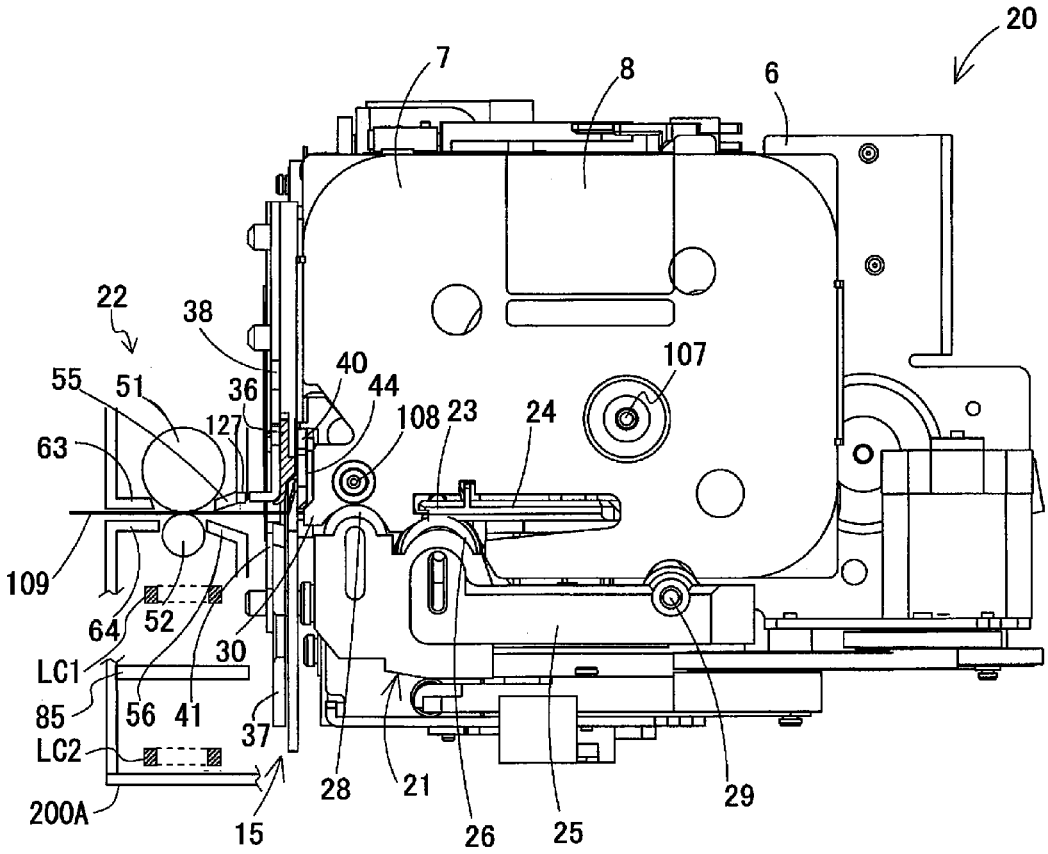
FIG. 19 is a plan view illustrating a structure of an internal unit in a variation using two antennas.

FIG. 19 is a plan view illustrating a structure of the internal unit 20 in this variation and corresponds to the above-mentioned FIG. 4A. The same reference numerals are given to the portions similar to those in FIG. 4A and description thereof will be omitted.

In FIG. 19, the internal unit 20 is provided with a first loop antenna LC1 (first antenna) provided with a communicable region inside the housing 200 and capable of information transmission/reception with the RFID circuit element To-W for a label production provided at the tag label tape 109 with print and a second loop antenna LC2 (second antenna) provided with a communicable region outside the housing 200 and capable of information transmission/reception with the RFID circuit element To-R for an information reading located outside the housing. Between the first loop antenna LC1 and the second loop antenna LC2, a shield member 85 (shield member) made of metal, for example, configured to shield a magnetic flux generated from the antennas LC1, LC2 are provided.

Figure 20:
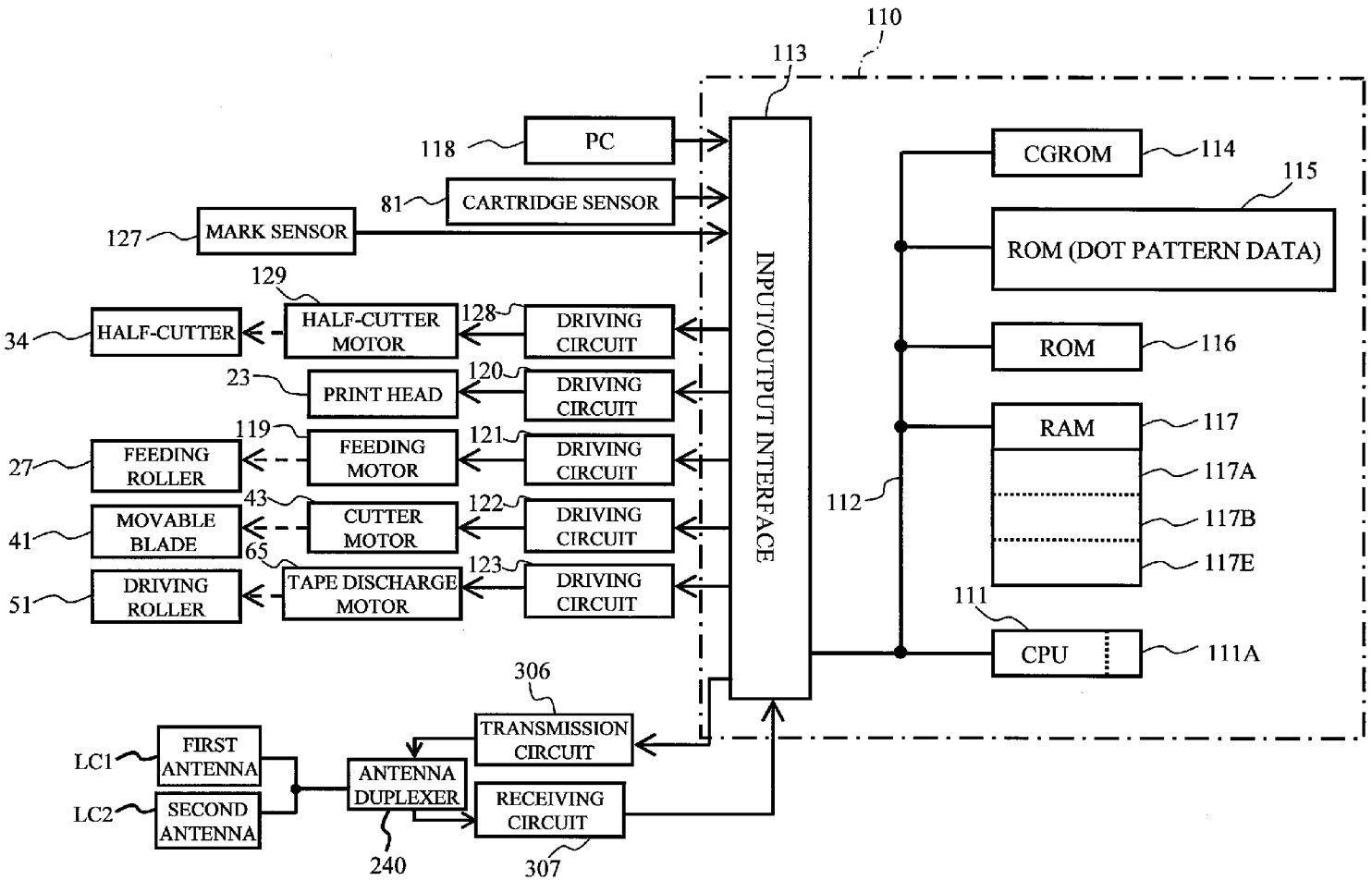
FIG. 20 is a functional block diagram illustrating a control system of the apparatus for producing RFID labels in the variation using two antennas.

FIG. 20 is a functional block diagram illustrating a control system of the apparatus 1 for producing RFID labels of this variation and corresponds to the above-mentioned FIG. 8. The same reference numerals are given to the portions similar to those in FIG. 8 and description thereof will be omitted.

As shown in FIG. 20, the first and second loop antennas LC1, LC2 are both connected to the above-mentioned antenna duplexer 240 in parallel, and a transmission signal generated at the transmission circuit 306 is transmitted to the RFID circuit element To-W for a label production provided at the tag label tape 109 with print and the RFID circuit element To-R for an information reading located outside the housing 200 through the antenna duplexer 240 and the first/second loop antennas LC1, LC2. Also, a response signal from the RFID circuit element To-W provided at the tag label tape 109 with print and the RFID circuit element To-R located outside the housing 200 is received at the receiving circuit 307 through the first/second loop antennas LC1, LC2 and the antenna duplexer 240.

In this variation, since the control procedure executed by the control circuit 110 is the same as that of the above embodiment (FIGS. 13 to 18), description thereof will be omitted.

In the variation described above, the same advantage as that of the above embodiment is obtained and moreover, as compared with the radio communication with the RFID circuit elements To-W, To-R in and outside the housing with the single loop antenna LC as in the above embodiment, since radio communication is carried out individually by the first and second loop antennas LC1, LC2 for information transmission/reception with the respective RFID circuit elements To-W, To-R, assuredness/reliability of the communication can be improved.

Particularly in this variation, since the first and second loop antennas LC1, LC2 are arranged with the shield member 85 held between them, interference between the communicable regions of the two loop antennas LC1, LC2 can be prevented.

(ii) When Antennas are Switched:

In the above embodiment, the communicable regions are provided both inside and outside the housing 200 of the apparatus main body 2 by the single loop antenna LC, but not limited to that, the communicable regions can be provided both inside and outside the housing 200 using two antennas. This variation is an example in which the antennas are switched at mode switching between the scan mode and the tag-label production mode.

In this variation, similarly to the above variation (i), the internal unit 20 is provided with the first loop antenna LC1 (first antenna) provided with the communicable region inside the housing 200 and capable of information transmission/reception with the RFID circuit element To-W for a label production provided at the tag label tape 109 with print and the second loop antenna LC2 (second antenna) provided with the communicable region outside the housing 200 and capable of information transmission/reception with the RFID circuit element To-R for an information reading located outside the housing. In addition, between the first loop antenna LC1 and the second loop antenna LC2, the shield member 85 is provided (See FIG. 19).

Figure 21:
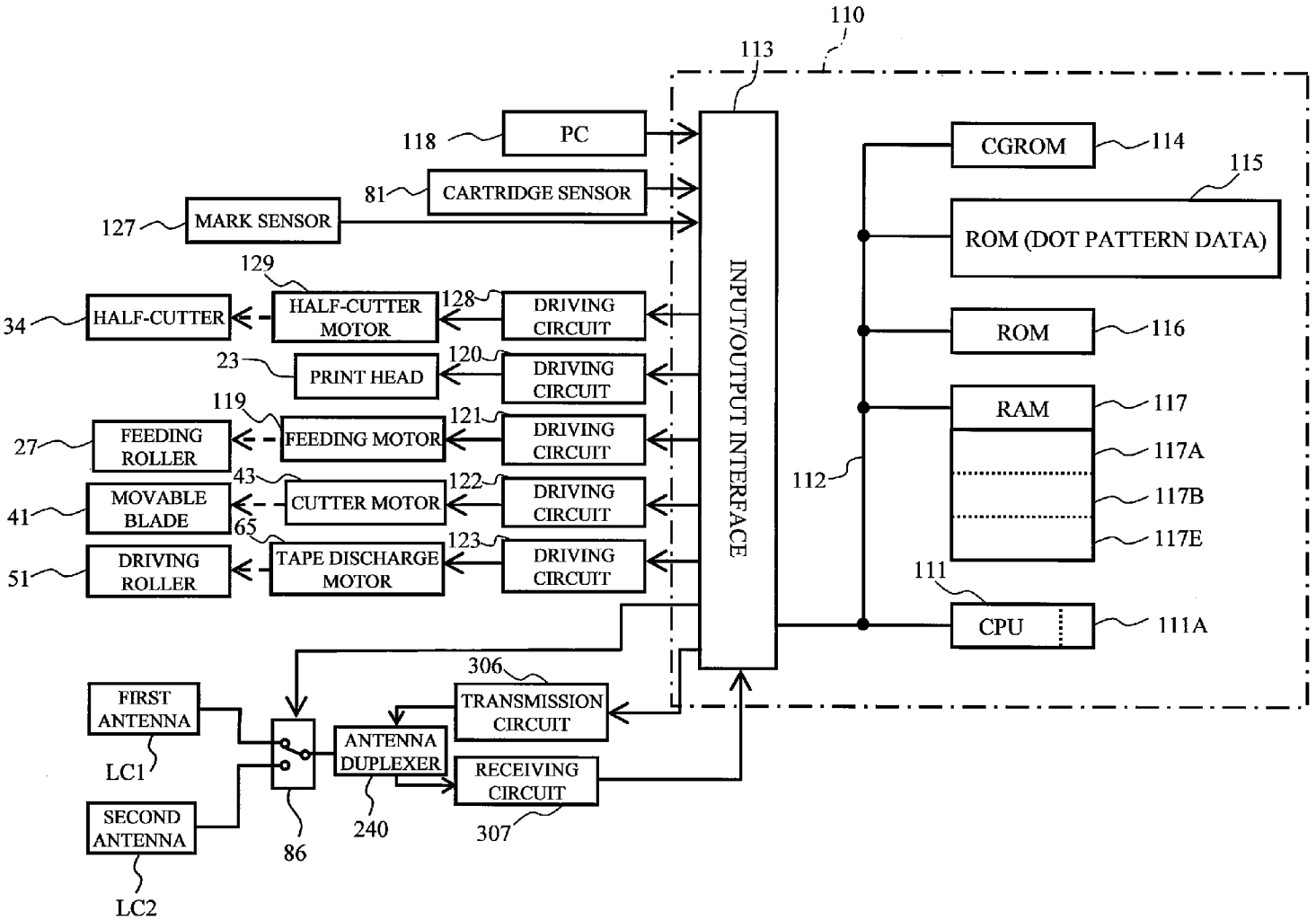
FIG. 21 is a functional block diagram illustrating the control system of the apparatus for producing RFID labels in the variation using two antennas.

FIG. 21 is a functional block diagram illustrating a control system of the apparatus 1 for producing RFID labels of this variation and corresponds to the above-mentioned FIG. 8. The same reference numerals are given to the portions similar to those in FIG. 8 and description thereof will be omitted.

In FIG. 21, the apparatus 1 for producing RFID labels of this variation has a switching circuit 86 (switching connection portion) that switches the antenna duplexer 240 to be connected to the first loop antenna LC1 or to the second loop antenna LC2, based on a control signal from a control circuit 110' (command-information generating portion). That is, if there is an instruction input of label production from an operator and the attached cartridge 7 is for a tag label production, the control circuit 110' changes the mode to the tag-label production mode and switches the switching circuit 86 so as to connect the antenna duplexer 240 and the first loop antenna LC1, while in a usual case where there is no instruction input of label production from the operator, the mode is changed to the scan mode and the switching circuit 86 is switched to connect the antenna duplexer 240 and the second loop antenna LC2.

Figure 22:
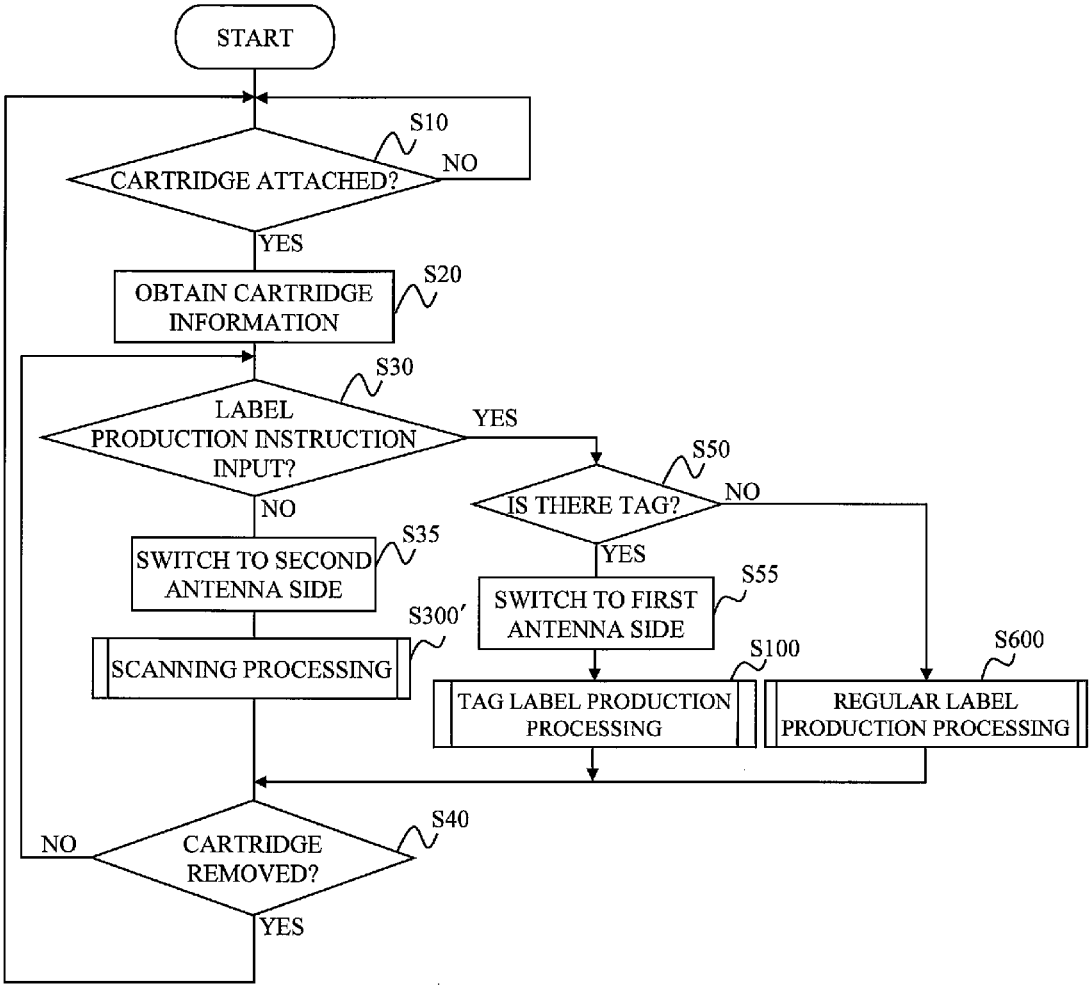
FIG. 22 is a flowchart illustrating a control procedure executed by the control circuit in the variation using two antennas.

FIG. 22 is a flowchart illustrating a control procedure executed by the control circuit 110' and corresponds to the above-mentioned FIG. 13. The same reference numerals are given to the procedure similar to those in FIG. 13 and description thereof will be omitted.

In FIG. 22, Step S10 to Step S30 are the same as in the above-mentioned FIG. 13, and first, it is determined if the cartridge 7 is attached to the cartridge holder 6 or not, and if attached, the cartridge information of the cartridge 7 (here, information on whether the cartridge 7 is for a tag label production or for an usual label production not having a tag. The tag ID information of all the RFID circuit elements To-W for a label production present in the cartridge is not required.) based on a detection signal input from the cartridge sensor 81 is obtained. Then, it is determined if there has been the instruction input of label production by the operator or not, and if there is no instruction input (that is, in the usual case), the determination is not satisfied and the routine goes to the subsequent Step S35.

At Step S35, a control signal is output to the switching circuit 86 so as to switch the switching circuit 86 and connect the antenna duplexer 240 and the second loop antenna LC2.

After that, the scan processing is carried out at Step S300', and at Step S40, it is determined if the cartridge 7 has been removed from the cartridge holder 6 or not.

On the other hand, if there is the instruction input of label production by the operator at Step S30, the determination is satisfied and the routine goes to the subsequent Step S50, and based on the cartridge information obtained at Step S20, it is determined if the cartridge 7 is for a tag label production or for an usual label production not having a tag. If the cartridge 7 is a cartridge for a tag label production, the determination is satisfied and the routine goes to the subsequent Step S55.

At Step S55, a control signal is output to the switching circuit 86 so as to switch the switching circuit 86 and connect the antenna duplexer 240 and the first loop antenna LC1. After that, the tag label production processing at Step S100 is carried out. Note that, the procedures other than those described above are the same as in the above-mentioned FIG. 13.

Figure 23:
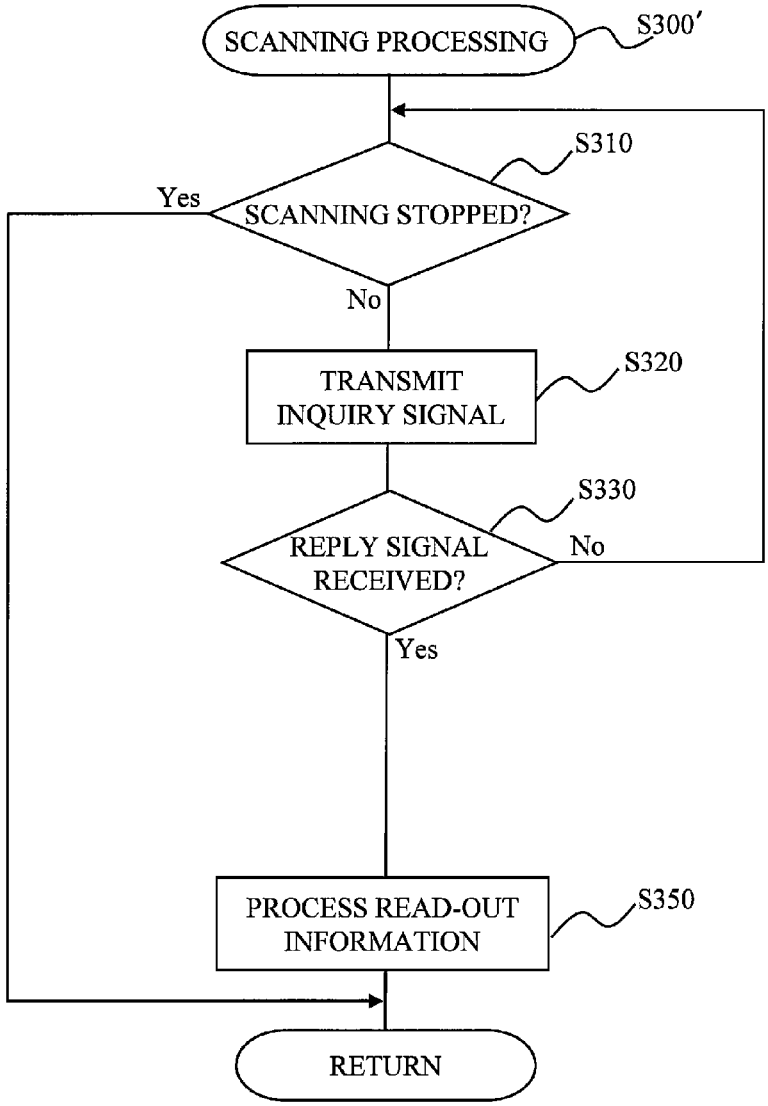
FIG. 23 is a flowchart illustrating a detailed procedure of Step S300'.

FIG. 23 is a flowchart illustrating a detailed procedure of the above-mentioned Step S300' and corresponds to the above-mentioned FIG. 14. In FIG. 23, a point different from the above-mentioned FIG. 14 is that the procedure of Step S340 is not needed any more. That is, in this variation, by switching the switching circuit 86 according to the mode as mentioned above, the transmission circuit 306 and the receiving circuit 307 are connected to the loop antennas LC1, LC2 according to each mode, and radio communication is not performed with the RFID circuit element To-W for a label production provided at the tag label tape 109 with print in the apparatus main body 2 in the scan mode or the radio communication is not performed with the RFID circuit element To-R for an information reading outside the apparatus main body 2 in the tag-label production mode. Therefore, since there is no need to check if the read-out tag ID is the RFID circuit element To-W of the cartridge 7 or not, the procedure of Step S340 is not needed. The other procedures are the same as in FIG. 14.

Figure 24:
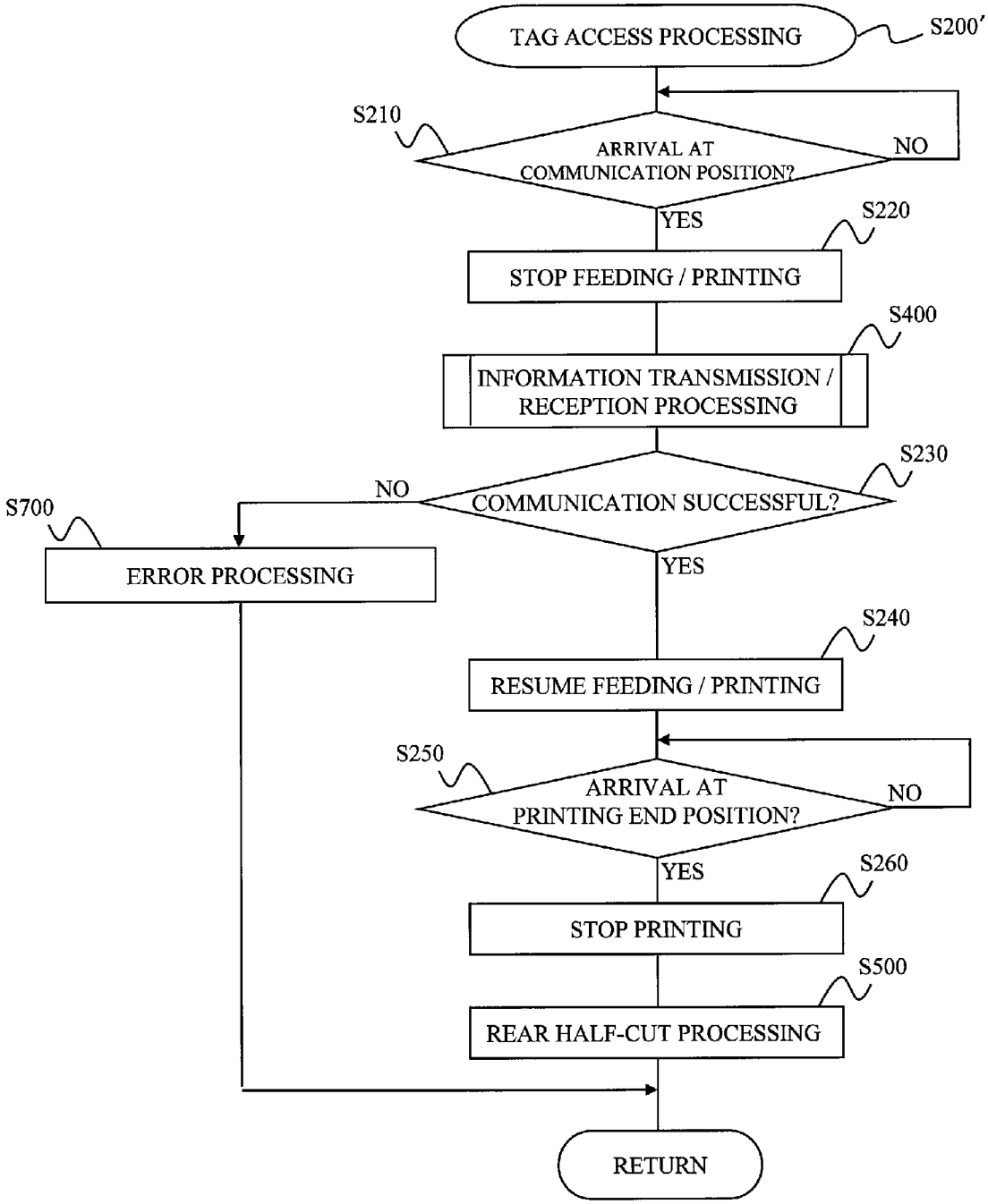
FIG. 24 is a flowchart illustrating a detailed procedure of Step S200'.

FIG. 24 is a flowchart illustrating a detailed procedure of the tag access processing (Step S200') executed by the control circuit 110' of this variation and corresponds to the above-mentioned FIG. 16. In FIG. 24, a point different from FIG. 16 is that Step 225 and Step 227, which are procedures to read out the tag ID and to check if the tag ID is the RFID circuit element To-W for a label production of the cartridge 7 or not, are not needed any more due to the same reason as the above. The other procedures are the same as in FIG. 16.

In the variation described above, by switching the antenna to be connected to the transmission circuit 306 and the receiving circuit 307 to the first loop antenna LC1 or the second loop antenna LC2 by the switching circuit 86, both the inside and outside the housing can be made communicable ranges, by which the information transmission/reception to the RFID circuit element To-R for an information reading outside the housing and the information transmission/reception to the RFID circuit element To-W for a label production fed in the housing can be carried out surely. Also, since the procedure to read out the tag ID so as to check if it is the RFID circuit element To-W of the cartridge 7 or not is not needed any more, the control procedure can be simplified. Moreover, since there is no need to read out the ID information of all the RFID circuit elements To-W provided at the cartridge, the cartridge information provided on the side of the cartridge can be reduced.

In the above variations (i) and (ii), the loop antenna configured in the loop coil shape is used for both the two antennas, but not limited to that, a patch antenna may be used for the two antennas. Alternatively, one may be a loop antenna and the other may be a patch antenna.

Also, in the above variation, the case where the operation mode is switched according to the instruction input of the operator has been described, but not limited to that, the operation mode may be selected according to the attached state of the cartridge 7 in the cartridge holder 6.

Figure 25:
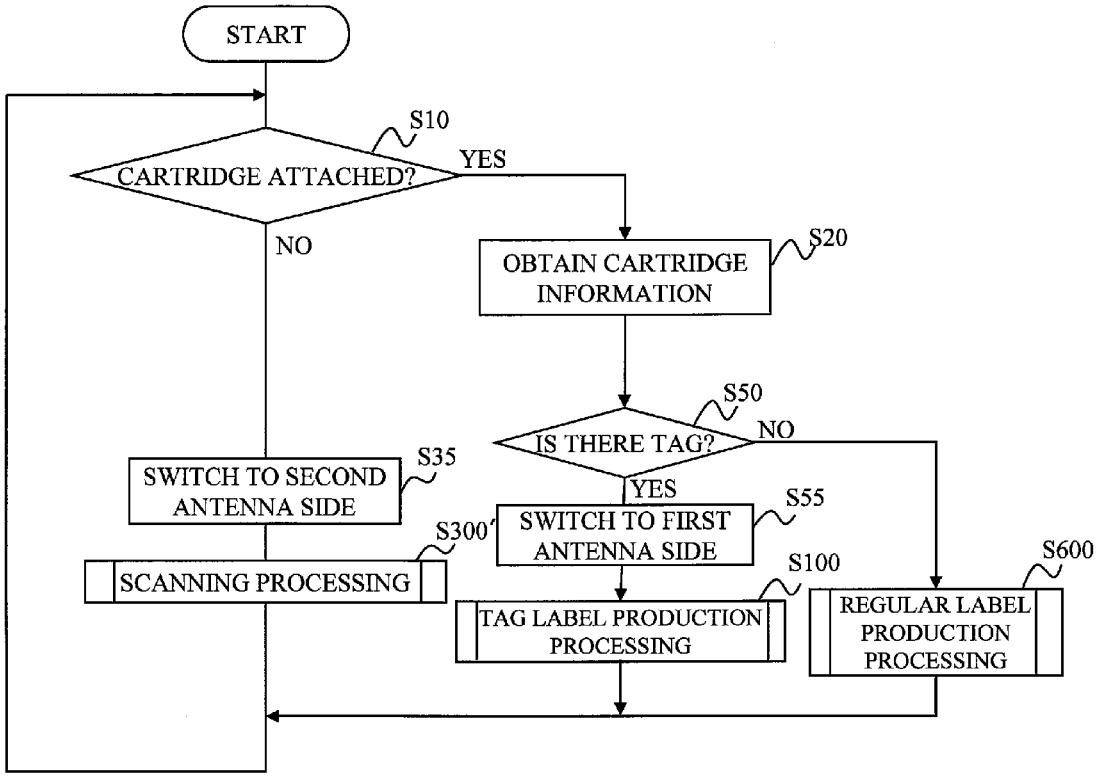
FIG. 25 is a flowchart illustrating a control procedure executed by the control circuit in a variation when an operation mode is switched according to an attached state of a cartridge in a cartridge holder.

FIG. 25 is a flowchart illustrating a control procedure executed by the control circuit in this case. As shown in FIG. 25, it is determined if the cartridge 7 is attached to the cartridge holder 6 at Step S10, and if not attached, the switching circuit 86 is switched at Step S35 so that the antenna duplexer 240 and the second loop antenna LC2 are connected, and the scan processing is carried out at Step S300'. On the other hand, if the cartridge 7 is attached to the cartridge holder 6, the determination at Step S10 is satisfied, and at the subsequent Step S20, the cartridge information (here, information if the cartridge 7 is for a tag label production or for an usual label production not having a tag) is obtained, and according to thus obtained cartridge information, the tag label production processing or usual label production processing is carried out.

According to this variation, since even if the cartridge 7 is not attached to the cartridge holder 6, information of the RFID circuit element To-R for an information reading outside can be read out in the scan mode, even while a tag label is not produced, the second loop antenna LC2, the control circuit 110', and the transmission/receiving circuits 306, 307 and the like are not left idle but can be used effectively.

(2) When Two Scan Modes are Provided:

In the above embodiment, only one scan mode is provided in the control configuration, but not limited to that, two scan modes may be provided. Note that, this variation is an example of a case where the communicable regions are provided both inside and outside the housing 200 using two antennas similarly to the above variation (1).

Figure 26A:
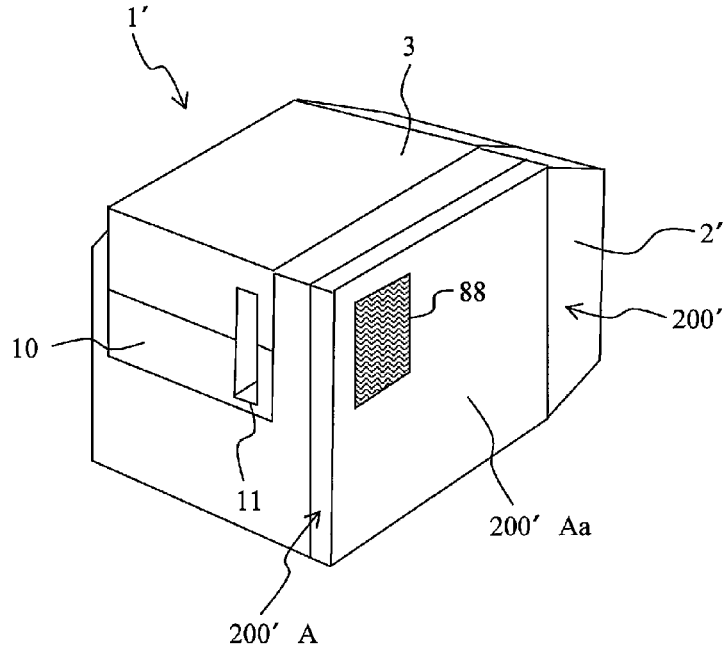
FIGS. 26A and 26B are perspective views schematically illustrating an entire structure of the apparatus for producing RFID labels in a variation having two scan modes.
Figure 26B:
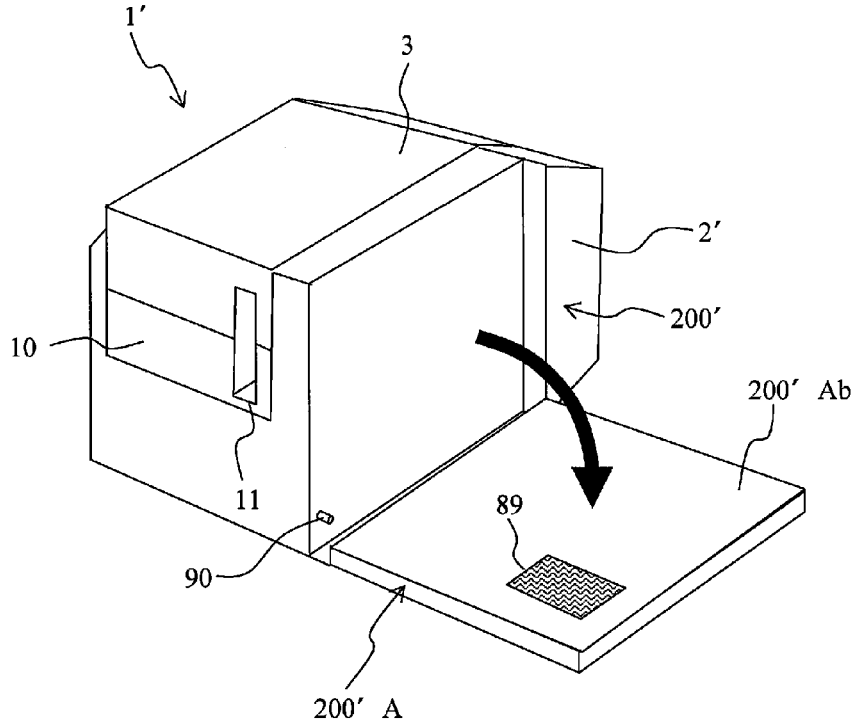

FIGS. 26A and 26B are perspective views schematically illustrating an entire structure of an apparatus 1' for producing RFID labels of this variation. In FIGS. 26A and 26B, the same reference numerals are given to the same portions as those in the above-mentioned FIG. 2 and description thereof will be omitted.

In FIGS. 26A and 26B, a housing 200' of an apparatus main body 2' in the apparatus 1' for producing RFID labels is located on the side of the apparatus (front right side in FIG. 26) and is provided with a side wall 200'A (opening/closing portion) that can be opened to the side with a lower end rotatably supported. In the side wall 200'A, first and second loop antennas LC1', LC2' are provided with the shield member 87 (shield member) held between them (See FIG. 27, which will be described later). At a position corresponding to the second loop antenna LC2' of an outer peripheral surface 200'Aa of the side wall 200'A, a display portion 88 showing a position to place the RFID circuit element To-R for an information reading (RFID label and the like) when the apparatus 1' for producing RFID labels is used in a first scan mode (scan mode while the side wall 200'A is closed. The state shown in FIG. 26A) is provided, and at a position corresponding to the first loop antenna LC1' of an inner peripheral surface 200'Ab of the side wall 200'A, a display portion 89 showing a position to place the RFID circuit element To-R for an information reading (RFID label and the like) when the apparatus 1' for producing RFID labels is used in a second scan mode (scan mode while the side wall 200'A is opened. The state shown in FIG. 26B) is provided.

Also, the apparatus main body 2' is provided with an opening/closing detection sensor 90 (limit switch, for example) that detects an open/closed state of the side wall 200'A (See FIG. 26B). This opening/closing detection sensor 90 (opening/closing detecting device) detects an open/closed state of the side wall 200'A and outputs the detected signal to a control circuit 110".

Figure 27:
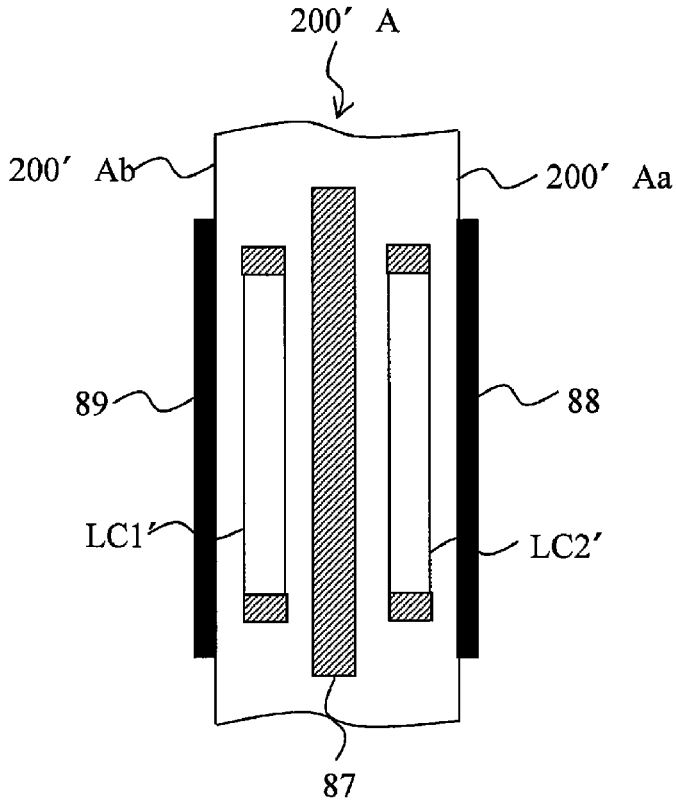
FIG. 27 is a sectional view of first and second loop antenna installation portions of a side wall in the variation having two scan modes.

FIG. 27 is a sectional view of a portion where the first and second loop antennas LC1', LC2' are installed in the side wall 200A. As shown in FIG. 27, in the side wall 200'A, the second loop antenna LC2' on the outer periphery side and the first loop antenna LC1' on the inner periphery side are provided with the shield member 87 held between them. The first loop antenna LC1' is, if the side wall 200'A is closed and in the tag-label production mode, provided with the communicable region on the inside of the housing 200' and is capable of information transmission/reception to the RFID circuit element To-W for a label production provided at the tag label tape 109 with print. If the side wall 200'A is opened and the mode is in the second scan mode, the communicable region is provided on the outside (upper side of the side wall 200'A) of the housing 200' and information can be transmitted/received to the RFID circuit element To-R for an information reading located outside the housing. On the other hand, the second loop antenna LC2' is, if the side wall 200'A is closed and in the first scan mode, provided with the communicable region outside the housing 200' and capable of information transmission/reception to the RFID circuit element To-R for an information reading located outside the housing.

Figure 28:
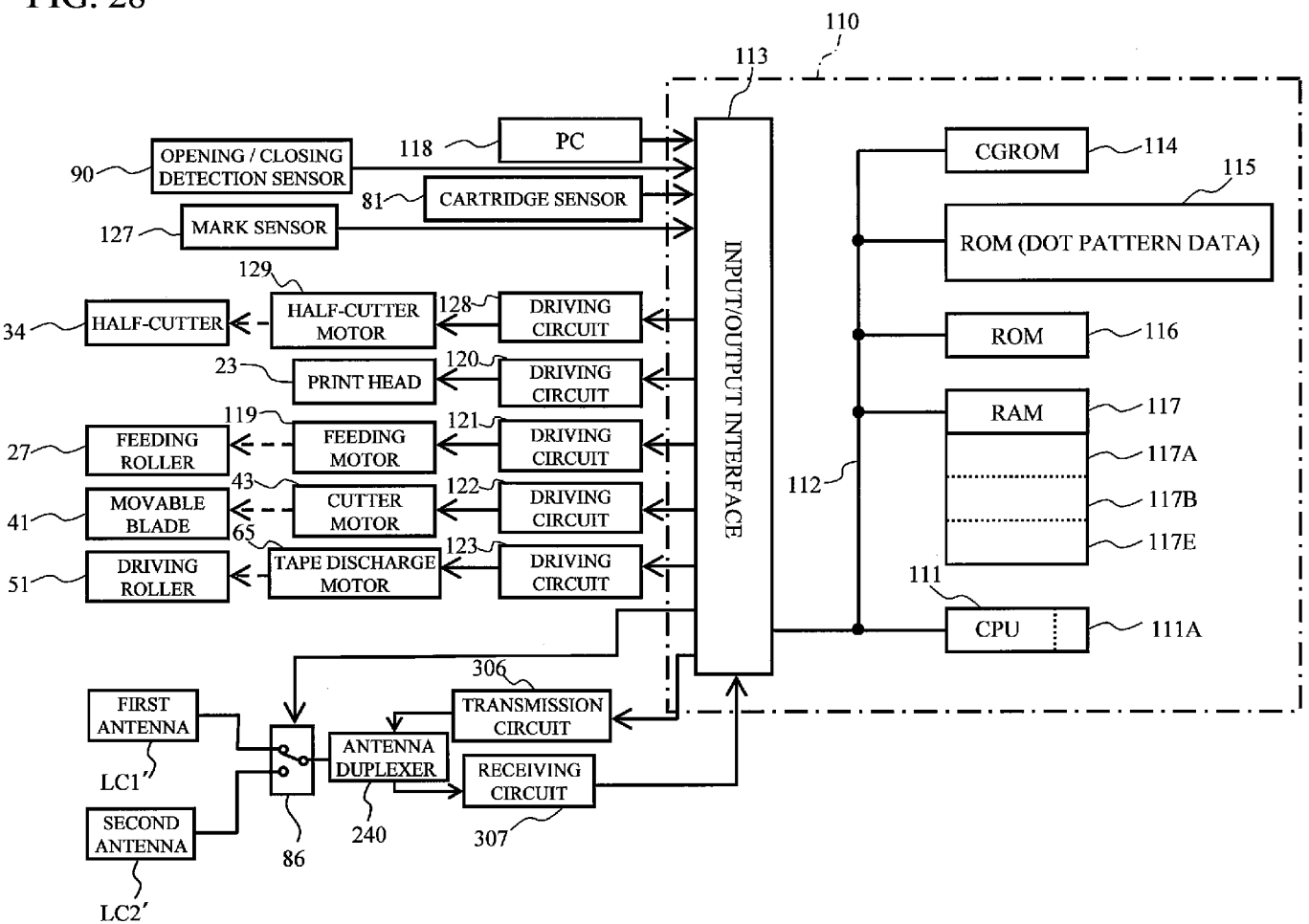
FIG. 28 is a functional block diagram illustrating a control system of the apparatus for producing RFID labels in the variation having two scan modes.

FIG. 28 is a functional block diagram illustrating a control system of the apparatus 1' for producing RFID labels of this variation and corresponds to the above-mentioned FIG. 21 and the like. In FIG. 28, to the input/output interface 113, the opening/closing detection sensor 90 that detects the open/closed state of the side wall 200'A is connected. Since the other configurations are the same as those in FIG. 21, description thereof will be omitted.

Figure 29:
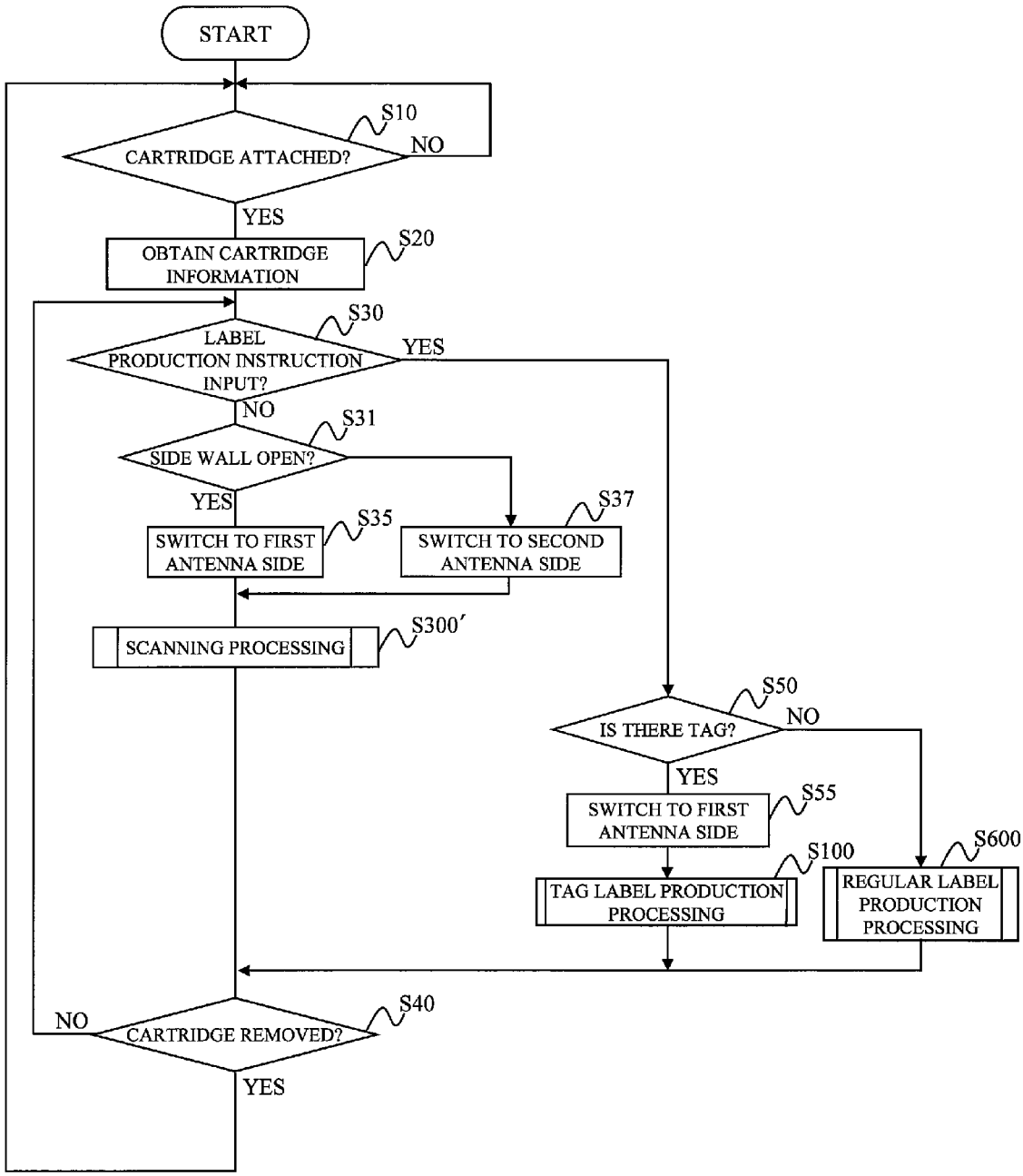
FIG. 29 is a flowchart illustrating a control procedure executed by a control circuit in the variation having two scan modes.

FIG. 29 is a flowchart illustrating a control procedure executed by the control circuit 110" and corresponds to the above-mentioned FIG. 22 and the like. The same reference numerals are given to the same procedures as in FIG. 22 and description thereof will be omitted as appropriate.

In FIG. 29, Step S10 to Step S30 are the same as in the above-mentioned FIG. 22. At Step S30, it is determined if there has been an instruction input for a label production from an operator, and if there is no instruction input (that is, in a usual case), the determination is not satisfied and the routine goes to the subsequent Step S31.

At Step S31, based on a detection signal input from the opening/closing detection sensor 90, it is determined if the side wall 200'A is open or not. If the side wall 200'A is open, the determination is satisfied and the routine goes to the subsequent Step S35, the mode is changed to the second scan mode, and a control signal is output to the switching circuit 86 so as to switch the switching circuit 86 and connect the antenna duplexer 240 and the first loop antenna LC1'. After that, the scan processing is carried out at Step S300'.

On the other hand, at Step S31, if the side wall 200'A is closed, the determination is not satisfied and the routine goes to Step S37, the mode is changed to the first scan mode, and a control signal is output to the switching circuit 86 so as to switch the switching circuit 86 and connect the antenna duplexer 240 and the second loop antenna LC2'. After that, the scan processing is carried out at Step S300'. The procedures other than those described above are the same as in the above-mentioned FIG. 22.

In the variation described above, two scan modes are provided, and while the side wall 200'A is opened, the tag label and the like provided with the RFID circuit element To-R for an information reading to be read-out can be scanned at the upper part of the opened side wall 200'A. Thus, operatability/convenience for the operator in the scan mode can be improved. Also, the mode can be switched between the first scan mode and the second scan mode according to the opening/closing of the side wall 200'A, by which the mode switching operation by the operator can be made simple and clear.

Note that, in the above variation, the communicable regions are provided both inside and outside the housing 200 using two antennas, but not limited to that, the communicable regions may be provided both inside and outside the housing 200 with a single antenna similarly to the above-mentioned first embodiment. In this case, it may be so configured that when the side wall 200'A is closed, the mode is switched to the tag-label production mode (or usual label production mode), while if the side wall 200'A is opened, the mode is switched to the scan mode.

Also, in the above variation, it may be so configured that a lock mechanism that locks the side wall 200'A in the closed state is provided, and at communication between the first loop antenna LC1' and the RFID circuit element To-W for a label production provided at the tag label tape 109 with print in the tag-label production mode, the side wall 200'A is locked by the lock mechanism so as not to be opened.

Also, though a transmission output is not controlled in the above variation, it may be so configured that the transmission output at scanning when the side wall 200'A is opened (second scan mode) is controlled to be smaller than the transmission output at scanning when the side wall 200'A is closed (first scan mode), for example. With this configuration, in scanning while the side wall 200'A is opened, reading-out of information in the RFID circuit element To-W for a label production in the apparatus main body 2' can be prevented.

Also, in the variations (1) and (2), the loop antenna configured in the loop coil shape is used for the two antennas, but not limited to that, a patch antenna may be used for the two antennas. Alternatively, one may be a loop antenna, while the other may be a patch antenna.

(3) When Directivity Switching is Carried Out by Array Antenna:

In the above embodiment, the loop antenna is used, but not limited to that, by carrying out directivity control using a phased array antenna, the communicable regions may be provided both inside and outside the housing 200.

Figure 30:
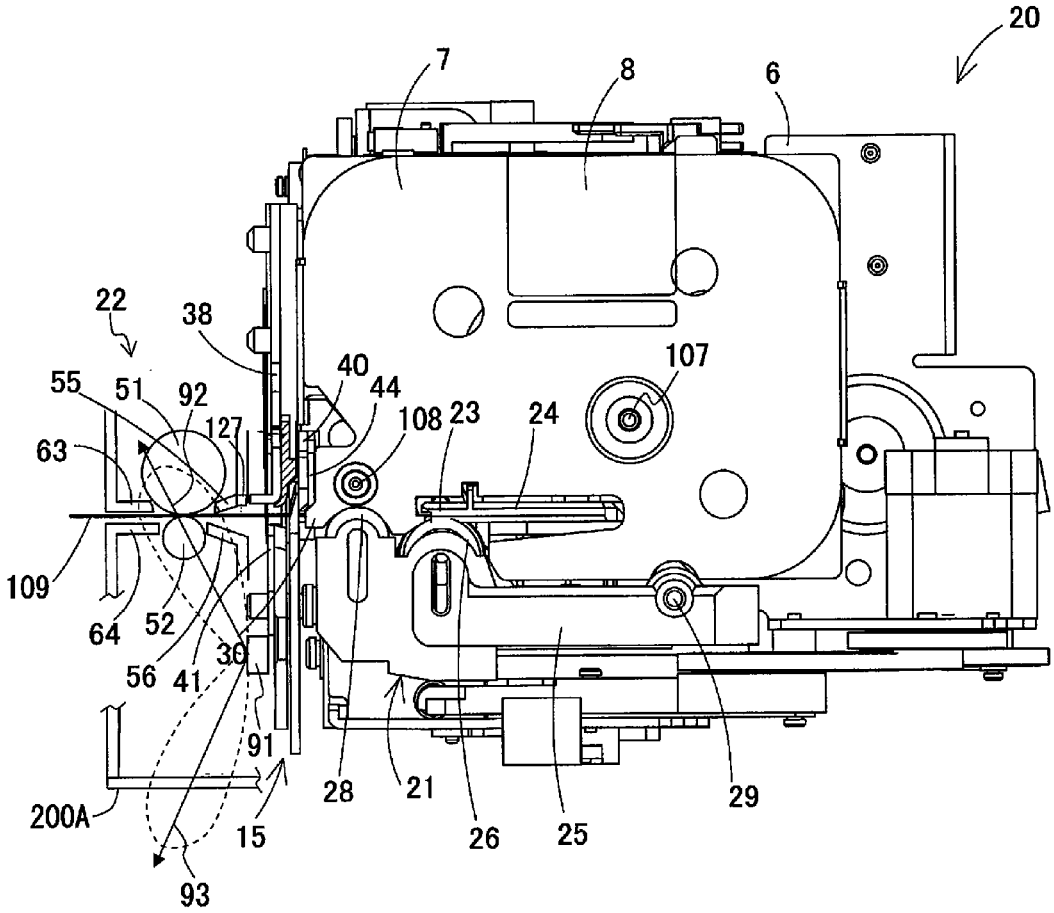
FIG. 30 is a plan view illustrating a structure of the internal unit in a variation in which directivity is switched by an array antenna.

FIG. 30 is a plan view illustrating a structure of the internal unit 20 in this variation and corresponds to the above-mentioned FIG. 19 and the like. The same reference numerals are given to the same portions as those in the above-mentioned FIG. 19 and description thereof will be omitted.

In FIG. 30, the internal unit 20 is provided with a phased array antenna 91 having a plurality of antenna elements (not shown) for both transmission and reception for signal transmission/reception via radio communication with the RFID circuit elements To-W, To-R. Directivity of the phased array antenna 91 has its main lobe direction changed by directivity control executed by the control circuit (directivity control portion) to a direction of an arrow 93 from a direction of an arrow 92 in the figure. That is, in the tag-label production mode, control is made so that the main lobe direction is the arrow 92 direction, and information can be written or read via radio communication with respect to the RFID circuit element To-W for a label production provided at the tag label tape 109 with print. On the other hand, in the scan mode, the control is made so that the main lobe direction is the arrow 93 direction, and information can be written or read via radio communication with respect to the RFID circuit element To-R for an information reading located outside the apparatus main body 2 (housing 200).

In the variation described above, too, the same effect as that in the above embodiment can be obtained.

(4) When Label Printing is Carried Out According to Scanned Contents:

In the above embodiment, based on the printing information input by the operator from the PC 118 or the RFID tag information read out of the RFID circuit element To-W for a label production, the label is printed in the tag label production processing or the usual label production processing, but not limited to that, the label may be printed based on the RFID tag information read out of the RFID circuit element To-R for an information reading outside the apparatus in the scan processing.

Figure 31:
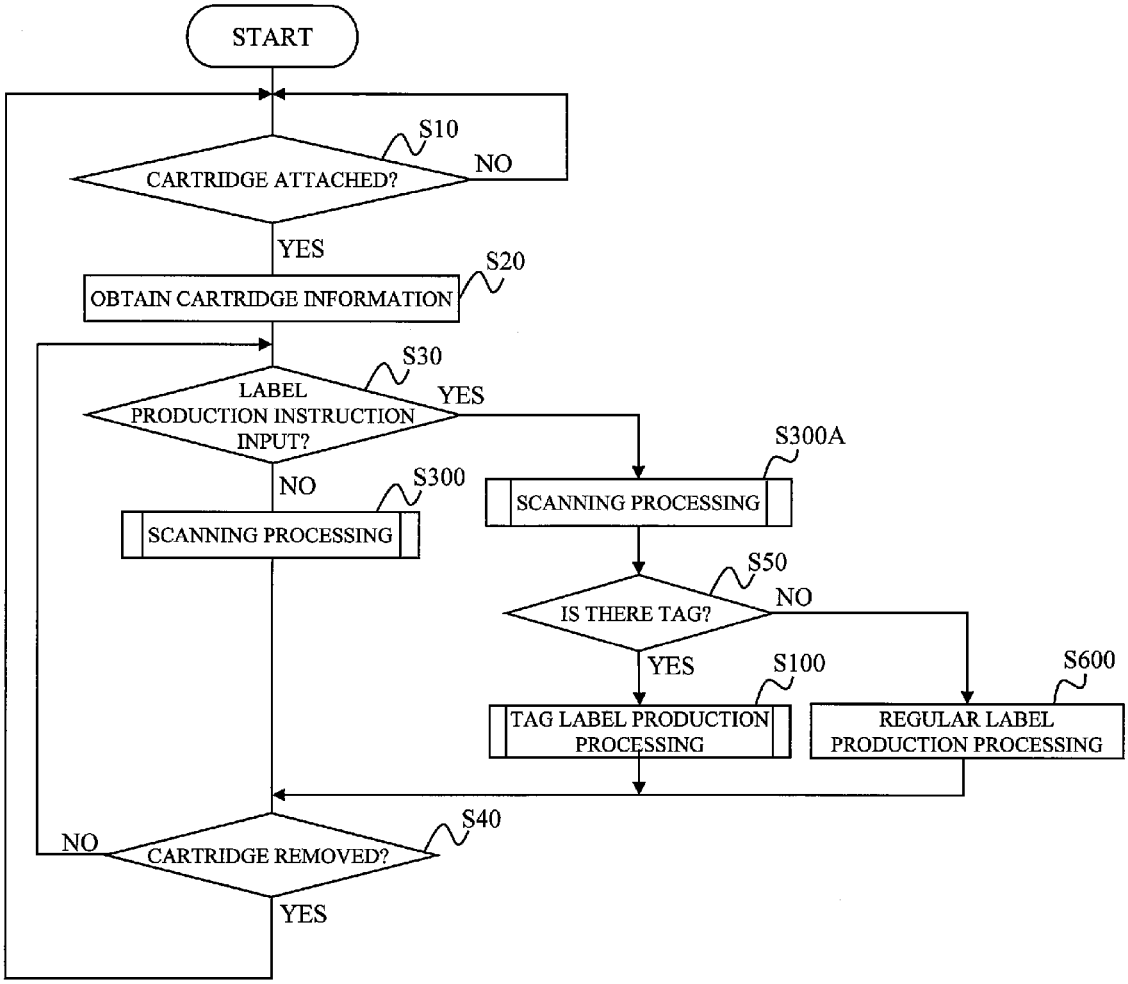
FIG. 31 is a flowchart illustrating a control procedure executed by the control circuit in a variation in which label printing is made according to scan contents.

FIG. 31 is a flowchart illustrating a control procedure executed by a control circuit 110''' of this variation and corresponds to the above-mentioned FIG. 13 and the like. The same reference numerals are given to the same procedures as in FIG. 13 and description thereof will be omitted as appropriate.

A point of this flow different from FIG. 13 is that the scan processing at Step S300A is carried out when a label production instruction is input from the operator and the determination at Step S30 is satisfied. In this variation, after the scan processing, the tag label production processing at Step S100A or the usual label production processing at Step S600A is carried out.

Figure 32:
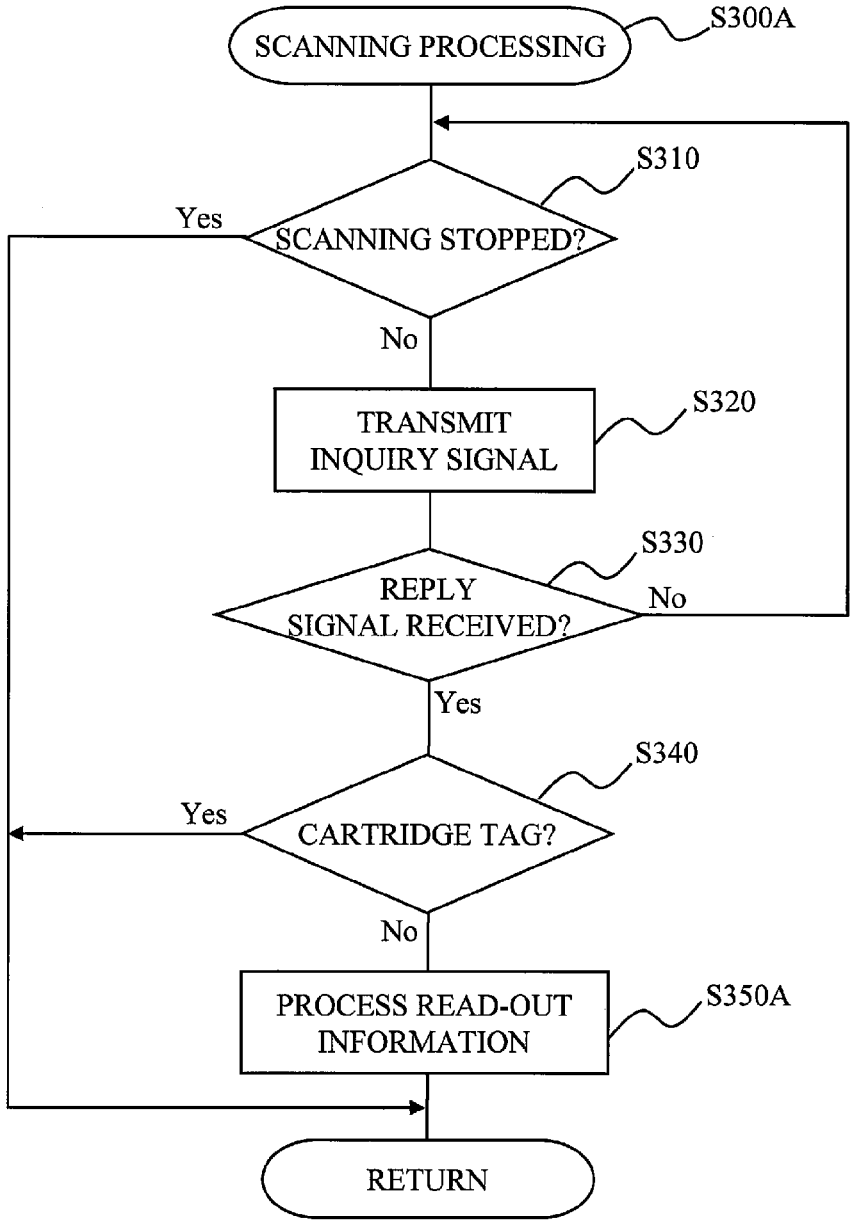
FIG. 32 is a flowchart illustrating a detailed procedure of Step S300A.

FIG. 32 is a flowchart illustrating a detailed procedure of the above-mentioned Step S300A and corresponds to the above-mentioned FIG. 14. The same reference numerals are given to the same procedures as in FIG. 14 and description thereof will be omitted as appropriate.

In FIG. 32, Step S310 to Step S340 are similar to the above-mentioned FIG. 14. That is, it is determined if an instruction to stop scanning is input from an operator or not and if not, an inquiry signal is transmitted to the RFID circuit element To-R, which is a reading target outside the apparatus, and when a reply signal is received from the RFID circuit element To-R, it is determined if the RFID circuit element To-R as the reading target having transmitted the reply signal is the RFID circuit element To-W for a label production of the cartridge 7 or not. If it is not the RFID circuit element To-W of the cartridge 7, the determination at Step S40 is satisfied and the routine goes to the subsequent Step S350A.

At Step S350A, the RFID tag information obtained from the RFID circuit element To-R as the reading target based on the above received reply signal is processed as appropriate. In this variation, processing to subtract a predetermined amount (amount of a purchased goods, for example) from balance information of electronic money stored in the RFID circuit element To-R (or balance information obtained from the information server IS and the like based on the tag ID stored in the RFID circuit element To-R), processing to obtain an article name (the name of the purchased goods and the like, for example) at which the RFID circuit element To-R is provided from the information server IS and the like based on the tag ID stored in the RFID circuit element To-R and the like are carried out, for example. Then, the information after the processing is stored in an appropriate memory (RAM 117, for example). Note that, the above processed information may be output through the input/output interface 113 and the communication line NW and stored in the information server IS or the route server RS so that the information can be referred to as necessary from the PC 118 or may be displayed by the display device of the PC 118. Then this flow is finished.

Figure 33:
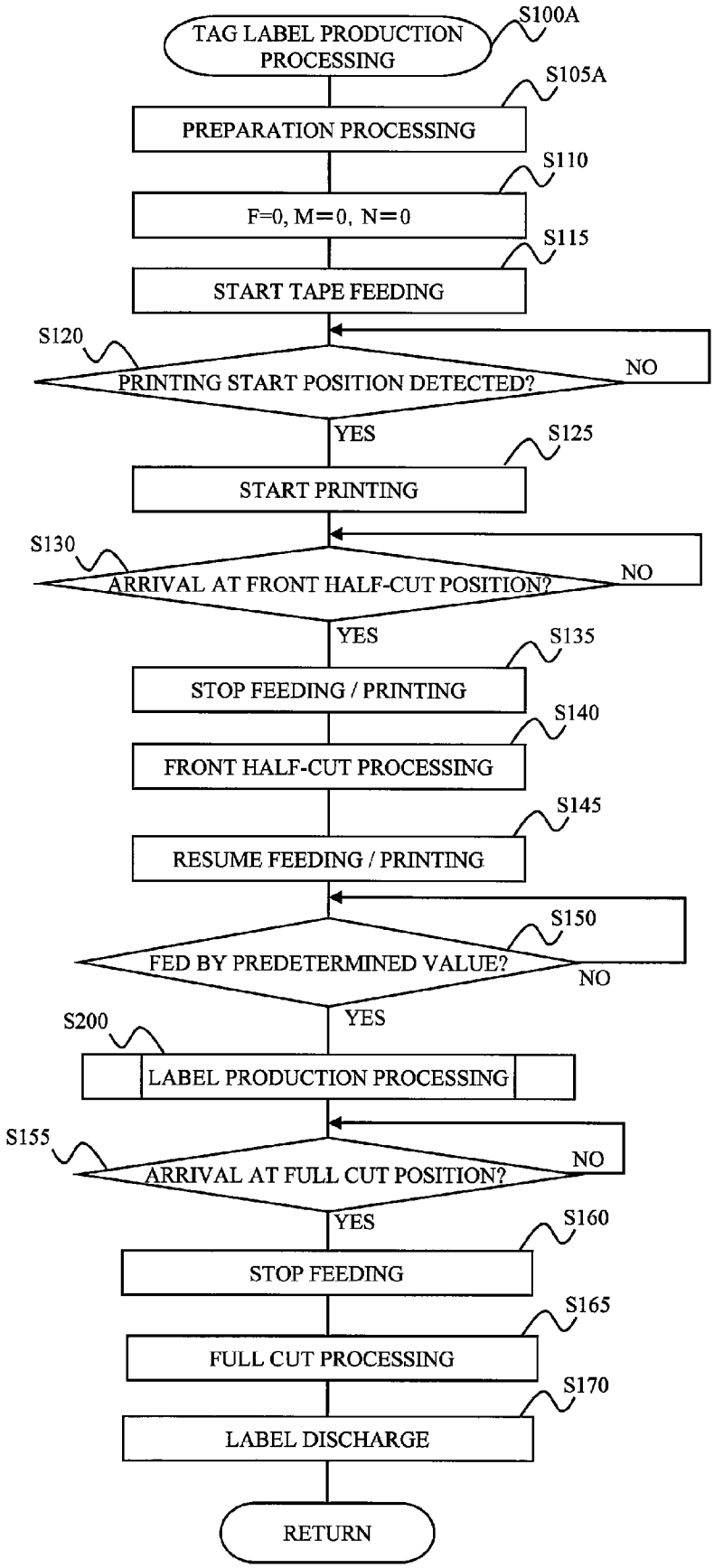
FIG. 33 is a flowchart illustrating a detailed procedure of Step S100A.

FIG. 33 is a flowchart illustrating a detailed procedure of the above-mentioned Step S100A and corresponds to the above-mentioned FIG. 15. The same reference numerals are given to the same procedures as in FIG. 14 and description thereof will be omitted.

In FIG. 33, first, at Step S105A, the processing information applied with appropriate processing at Step S350A and stored in the memory is read out and based on the processing information, preparation processing including setting of the print data, communication data with the RFID circuit element To-W for a label production, front/rear half-cut positions, full-cut position and the like is executed. The subsequent Step S110 to Step S170 are the same as in FIG. 15, and the RFID label T on which the label printing corresponding to the processing information has been applied and information has been written in the RFID circuit element To-W is produced.

Figure 34:
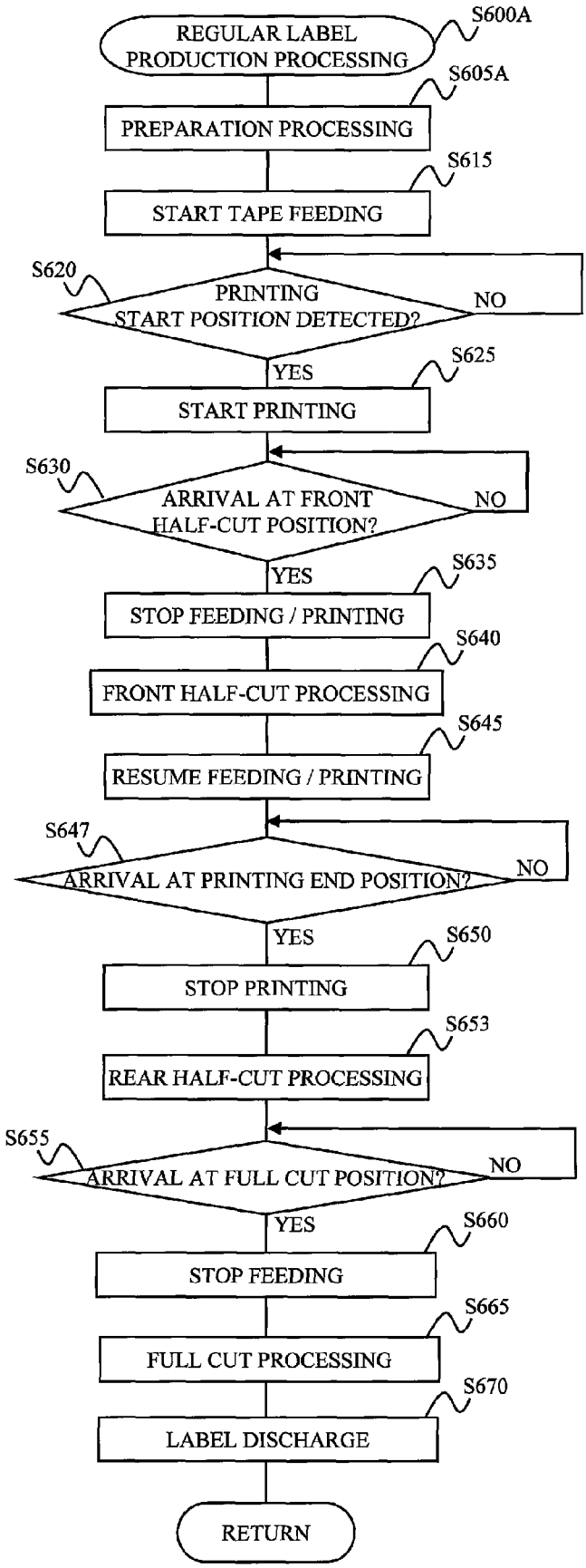
FIG. 34 is a flowchart illustrating a detailed procedure of Step S600A.

FIG. 34 is a flowchart illustrating a detailed procedure of the above-mentioned Step S600A and corresponds to the above-mentioned FIG. 18. The same reference numerals are given to the procedures similar to those in FIG. 18 and description thereof will be omitted.

In FIG. 34, first, at Step S605A, the processing information applied with appropriate processing at Step S350A and stored in the memory is read out, and based on the processing information, preparation processing including setting of the print data, front/rear half cut positions, full-cut position and the like is executed. The subsequent Step S610 to Step S670 are the same as in FIG. 18, and the label on which the label printing corresponding to the processing information is made is produced.

In the above, the procedure at Step S125 executed by the control circuit 110''' constitutes second print-control portion controlling the printing device described in claim 13. Also, the procedure at Step S350A executed by the control circuit 110''' constitutes information processing portion that carries out predetermined information processing described in claim 15.

In the variation described above, the RFID label T or the usual label in which the information transmission/reception contents are reflected can be produced by making a print corresponding to the information transmission/reception contents with the RFID circuit element To-R for an information reading outside the housing on the cover film 103. Also, the RFID label T in which the information transmission/reception contents are stored can be produced by writing the RFID tag information corresponding to the information transmission/reception contents with the RFID circuit element To-R for an information reading outside the housing in the RFID circuit element To-W for a label production.

In the above variation, in the RFID label production processing and the usual label production processing, the RFID label T or the usual label is produced by full-cut processing by the cutting mechanism 15, but not limited to that, a tape produced without the cutting processing may be taken up in an uncut roll state or tape state.

(5) Others:

In the above, the information is read out of the RFID circuit element To-R for an information reading located outside the apparatus main body 2 (housing 200) on the side face of the apparatus main body 2 by providing the loop antenna LC on the side face of the apparatus main body 2, but not limited to that. That is, it may be so configured that the loop antenna LC is provided on the front face side or the upper face side of the apparatus main body 2 and information is read out of the RFID circuit element To-R for an information reading located outside the apparatus main body 2 (housing 200) on the front face side or the upper face side of the apparatus main body 2.

In the above, the apparatus for producing RFID labels having the opening/closing lid 3 on the upper side of the apparatus main body 2 and attached to the upper side with the cartridge 7 in the laterally arranged state (so-called laterally-arranged cartridge type) has been described as an example, but not limited to that, the present invention may be applied to the apparatus for producing RFID labels having the opening/closing lid on the side of the apparatus main body and attached to the side with the cartridge 7 in the vertically arranged state (so-called vertically-arranged cartridge type).

Also, in the above, the case where the RFID tag information is transmitted to the RFID circuit element To-W for a label production and written in the IC circuit part 151 so as to produce the RFID label T has been described, but not limited to that. That is, as having been already described, the present invention may be applied to a case where while RFID tag information is read out of the RFID circuit element To for reading only in which the predetermined RFID tag information is stored and held unrewritably in advance, the corresponding print is applied so as to produce the RFID label T, and the same effect as the above can be also obtained in this case.

Also, in the above, such method was used that the print is applied to the cover film 103 separate from the base tape 101 provided with the RFID circuit element To-W for a label production and they are bonded together, but not limited to that, the present invention may be applied to a method that the print is made in a print region of a print-receiving tape layer provided at the tag tape, for example (not-bonding type). In this case, configuration of the receiver 38 and the half-cutter 34 in the half-cut unit 35 is different from that in this embodiment. That is, the receiver is arranged on the side of the half-cutter 34 and the half-cutter is arranged on the side of the receiver 38 in FIG. 3.

Also, in the above, the case where the tag label T is produced by cutting the tag label tape 109 with print for which printing and an access (for reading or writing) to the RFID circuit element To-W for a label production has been finished by the cutting mechanism 15 has been described, but not limited to that. That is, if label mounts (so-called die-cut labels) separated in advance to a predetermined size corresponding to the label are sequentially arranged on the tape fed out of the roll, the tag label T may be produced by peeling off only the label mount (on which the accessed RFID circuit element To is provided and the print has been applied) from the tape after the tape is discharged from the label carry-out exit 11 without cutting it by the cutting mechanism 15, and the present invention can be also applied to such a case.

Moreover, in the above, such case where the first roll 102 is constituted by winding the base tape 101 around the reel member 102*a*, the roll is arranged in the cartridge 7 and the base tape 101 is fed out thereof has been described, but not limited to that. For example, a lengthy flat sheet or strip state tape or sheet on which at least one RFID circuit element To is arranged (including those formed by cutting it to an appropriate length after the tape wound around a roll is fed out) is stacked in a predetermined storage portion (flatly stacked in a tray-state container, for example) to be made into a cartridge, and the cartridge may be attached to a cartridge holder on the side of the apparatus for producing RFID labels so that transfer and transport are made from the storage portion for the print and writing and the RFID label is produced.

Moreover, it may be so configured that the roll is directly attached to the side of the apparatus for producing RFID labels detachably or the lengthy flat sheet or strip state tape or sheet is transferred from outside the apparatus for producing RFID labels one by one and supplied to the apparatus for producing RFID labels by a predetermined feeder mechanism, or furthermore, not even limited to those detachably attached on the side of the apparatus main body of the apparatus for producing RFID labels such as the cartridge 7, the first roll 102 may be provided as a so-called installed type or integral type non-detachably attached to the side of the apparatus main body. In this case, too, the same effect can be obtained.

The "Scroll ID" command signal, the "Erase" command signal, the "Verify" command signal, the "Program" command signal and the like used in the above shall comply with the specification formulated by EPC global. The EPC global is a non-profit corporation jointly established by International EAN Association, which is an international organization of distribution codes, and UCC (Uniformed Code Council), which is an U.S. distribution code organization. Signals complying with other standards will do as long as they serve the same functions.

Other than those mentioned above, methods of the embodiments and each variation may be combined as appropriate for use.

Though not specifically exemplified, the present invention should be put into practice with various changes made in a range not departing from its gist.

What is claimed is:

1. An apparatus for communicating with an RFID tag comprising:

a housing constituting an outer profile of an apparatus main body;

an apparatus antenna device provided with communicable regions both on an inside and an outside of said housing and configured for information transmission/reception with respect to an RFID circuit element provided with an IC circuit part storing information and a tag antenna for information transmission/reception;

a feeding device provided inside said housing and configured to feed a feeding medium;

a carry-out exit configured to discharge said feeding medium to an outside of said housing, disposed in a wall of said housing other than a bottom wall;

a container holder that detachably installs a container for including at least an RFID tag containing said feeding medium configured for continuous supply on which a plurality of said RFID circuit elements are arranged; and a mode control portion including a scan mode configured to perform information transmission/reception with said RFID circuit element located outside said housing through said apparatus antenna device and a tag-label production mode configured to perform information reading/writing in the communicable region on the inside of said housing with said RFID circuit element through said apparatus antenna device and then to carry out said RFID circuit element from said carry-out exit, the RFID circuit element provided at said feeding medium supplied from said container and fed by said feeding device, said mode control portion configured to control said apparatus antenna device corresponding to either one of said scan mode or said tag-label production mode.

2. The apparatus according to claim 1, wherein:

said apparatus antenna device is a single antenna having a directivity communicable both to said RFID circuit element for a label production provided at a tag medium as said feeding medium located inside said housing and to said RFID circuit element for a information reading located outside said housing.

3. The apparatus according to claim 2, further comprising a directivity control portion configured to control a direction of a main lobe by said single antenna.

4. The apparatus according to claim 1, wherein:

said apparatus antenna device includes a first antenna provided with said communicable region inside said housing and configured for information transmission/reception with respect to said RFID circuit element for a label production provided at a tag medium as said feeding medium and a second antenna provided with said communicable region outside said housing and configured for information transmission/reception with respect to said RFID circuit element for an information reading located outside said housing.

5. The apparatus according to claim 4, further comprising:

a command-information generating portion configured to generate command information for access to said IC circuit parts of said RFID circuit element for a label production and of said RFID circuit element for an information reading; and a switching connection portion for connection by selectively switching said command-information generating portion to said first antenna or said second antenna.

6. The apparatus according to claim 4, wherein:

said first antenna is arranged on one side and said second antenna is arranged on the other side through a shield member provided with a function to shield or attenuate a communication signal.

7. The apparatus according to claim 1, wherein:

said mode control portion controls said apparatus antenna device corresponding to said scan mode in a usual time and corresponding to said tag-label production mode in production of an RFID label.

8. The apparatus according to claim 1, wherein:

said housing has an opening/closing portion configured for opening/closing;

an opening/closing detecting device that detects an open/closed state of said opening/closing portion is provided; and said mode control portion performs mode switching control of said scan mode and said tag-label production mode according to a detection result of said opening/closing detecting device.

9. The apparatus according to claim 2, further comprising:

a container holder that detachably installs a container for including at least an RFID tag containing said tag medium configured for continuous supply on which a plurality of said RFID circuit elements for a label production is arranged; and a container-presence/absence detecting device that detects presence or absence of said container for including at least an RFID tag in said container holder, wherein said mode control portion performs mode switching control of said scan mode and said tag-label production mode according to a detection result of said container-presence/absence detecting device.

10. The apparatus according to claim 2, further comprising:

an information acquisition portion configured to obtain RFID tag information provided at said IC circuit parts of said RFID circuit element for a label production and of said RFID circuit element for an information reading; and a prohibition processing portion configured to prohibit a post processing using the obtained RFID tag information when said RFID tag information of said RFID circuit element for a label production provided at said tag medium is obtained by said information acquisition portion through said single antenna during control by said mode control portion in said scan mode; and configured to prohibit a tag label production processing using the obtained RFID tag information when said RFID tag information of said RFID circuit element for an information reading located outside said housing is obtained by said information acquisition portion through said single antenna during the control by said mode control portion in said tag-label production mode.

11. The apparatus according to claim 10, further comprising a container-information detecting device configured to detect container information of an object to be detected provided at said container for including at least an RFID tag installed in said container holder, wherein:

said prohibition processing portion performs said prohibition processing based on a detection result of said container-information detecting device.

12. The apparatus according to claim 2, further comprising:

a printing device configured to make a print on said tag medium or a print-receiving medium to be bonded said tag medium according to said information transmission/reception contents with said RFID circuit element for a label production of said tag medium through said single antenna; and a particular print-control portion configured to operate said printing device when detecting that said single antenna is controlled in correspondence with a tag-label production mode.

13. The apparatus according to claim 1, further comprising a further print-control portion configured to control said printing device so that a print is applied on said feeding medium or a print-receiving medium to be bonded said feeding medium according to said information transmission/reception contents with said RFID circuit element for an information reading located outside said housing through said apparatus antenna device.

14. The apparatus according to claim 13, further comprising a cutter configured to cut a label medium to a predetermined length so as to form a label, said label medium being formed by using said feeding medium or said print-receiving medium after printing by said printing device.

15. The apparatus according to claim 13, further comprising an information processing portion configured to perform predetermined information processing to said RFID circuit element for an information reading based on said information transmission/reception result with said RFID circuit element for an information reading located outside said housing, wherein:

said further print-control portion controls said printing device so that the print corresponding to the information processing by said information processing portion is made on said feeding medium or said print-receiving medium.

16. The apparatus according to claim 1, wherein:

an antenna included in said apparatus antenna device is at least one of a planar antenna, a dipole antenna provided extending substantially in a straight line, and a loop antenna configured to transmit/receive information by a magnetic induction.

17. The apparatus according to claim 1, wherein:

said apparatus main body is constituted substantially in a hexagonal shape and is provided with a carry-out exit that discharges said feeding medium to outside said housing on a side face other than the bottom face; and said apparatus antenna device is provided in the vicinity of at least one of an upper face and side faces adjacent to a side face having the carry-out exit.

18. A tag label producing apparatus comprising:

a housing;

a label producing portion configured to feed a tag tape and produce an RFID label, disposed inside said housing;

a label discharge portion configured to discharge said RFID label produced by said label producing portion to an outside of said housing from an inside of said housing, said label discharge portion disposed at a forward side from said label producing portion along a transport direction; and a reading portion configured to perform an information reading with said RFID label discharged by said label discharge portion and positioned outside of said housing, said reading portion disposed at one side from said label producing portion along a direction perpendicular to said transport direction, wherein said label producing portion comprises:

a cartridge holder arranged on said housing for detachably mounting thereon a cartridge configured to supply a tag tape including a tape RFID circuit element;

a feeding device configured to feed said tag tape supplied from said cartridge mounted said cartridge holder;

a print device configured to perform a desired print on said tag tape fed by said feeding device or on a print-receiving tape bonded to said tag tape;

an internal communication antenna configured to perform information transmission/reception with said tape RFID circuit element disposed at said tag tape fed by feeding device;

a cutting device configured to cut said tag tape having said tape RFID circuit element to produce said RFID label after completing the information transmission/reception with said tape RFID circuit element by said internal communication antenna; and said reading portion comprises:

an external communication antenna configured to perform information transmission/reception with at least said tape RFID circuit element disposed at said RFID label produced by label producing portion and discharged by label discharge portion, and wherein the tag label producing apparatus further comprises:

a control circuit;

an antenna switching device configured to connect said control circuit to said internal communication antenna or to said external communication antenna selectively; and a switching control portion configured to control said antenna switching device so that said control circuit is connected to said internal communication antenna when a label production process that said RFID label is produced by said label producing portion is practiced and said control circuit is connected to said external communication antenna when a housing-outside communication process that information reading is performed by said reading portion is practiced.

* * * * *